US009764914B2

(12) United States Patent
Machii et al.

(10) Patent No.: US 9,764,914 B2
(45) **Date of Patent: *Sep. 19, 2017**

(54) SHEET FEEDING APPARATUS WITH NIP GUIDE MEMBER

(71) Applicant: CANON KABUSHIKI KAISHA, Tokyo (JP)

(72) Inventors: Emi Machii, Izu (JP); Koji Kawamura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/959,193

(22) Filed: Dec. 4, 2015

(65) Prior Publication Data

US 2016/0083207 A1 Mar. 24, 2016

Related U.S. Application Data

(63) Continuation of application No. 14/146,071, filed on Jan. 2, 2014, now Pat. No. 9,242,820.

(30) Foreign Application Priority Data

Jan. 11, 2013 (JP) ..... 2013-003899

(51) Int. Cl.
*B65H 3/52* (2006.01)
*B65H 3/66* (2006.01)
(Continued)

(52) U.S. Cl.
CPC ..... *B65H 3/66* (2013.01); *B65H 3/0676* (2013.01); *B65H 3/5261* (2013.01); *B65H 3/56* (2013.01);
(Continued)

(58) Field of Classification Search
CPC .... B65H 5/062; B65H 5/068; B65H 2404/50; B65H 2404/64
See application file for complete search history.

(56) References Cited

U.S. PATENT DOCUMENTS 7,922,171 B2 4/2011 Kawamura et al.
8,403,322 B2 3/2013 Otsuki
(Continued)

FOREIGN PATENT DOCUMENTS

CN 102107789 A 6/2011
CN 102344045 A 2/2012
(Continued)

OTHER PUBLICATIONS

Chinese Office Action issued in corresponding Chinese Application No. 201410006028.6 dated Nov. 4, 2015.

*Primary Examiner* — Howard Sanders
(74) *Attorney, Agent, or Firm* — Fitzpatrick, Cella, Harper & Scinto

(57) ABSTRACT

A sheet feeding apparatus has a conveying roller, a separation member which presses against the conveying roller to form a separation nip portion that separates received sheets one by one, a feeding member configured to feed a sheet towards the separation nip portion, a nip guide member having a first guide portion configured to contact with a leading edge of the sheet fed by the feeding member and a second guide portion disposed at facing position to the conveying roller and configured to guide the sheet abutted with the first guide portion for the separation nip portion and a biasing member configured to bias the nip guide member. The nip guide member rotates around a rotation shaft and the second guide portion is disposed at predetermined distance from the conveying roller and moves in a direction of separating from the conveying roller against biasing force by the biasing member.

8 Claims, 19 Drawing Sheets

(51) Int. Cl.

| | |
|---|---|
| ***B65H 5/06*** | (2006.01) |
| ***B65H 3/56*** | (2006.01) |
| ***B65H 3/06*** | (2006.01) |

(52) U.S. Cl.

CPC ..... *B65H 5/062* (2013.01); *B65H 5/068* (2013.01); *B65H 2402/31* (2013.01); *B65H 2402/32* (2013.01); *B65H 2404/1341* (2013.01)

(56) References Cited

U.S. PATENT DOCUMENTS

| | | | | |
|---|---|---|---|---|
| 8,781,388 | B2 | 7/2014 | Yamaguchi et al. | |
| 2011/0156340 | A1* | 6/2011 | Otsuki ..... | B65H 1/04 271/10.09 |
| 2012/0025453 | A1 | 2/2012 | Yamaguchi et al. | |

FOREIGN PATENT DOCUMENTS

| | | | |
|---|---|---|---|
| EP | 2338815 | | 6/2011 |
| EP | 2338815 | B1 | 4/2014 |
| JP | 63-225044 | A | 9/1988 |
| JP | 2003-118865 | A | 4/2003 |
| JP | 2006-256780 | A | 9/2006 |
| JP | 2007-168931 | A | 7/2007 |
| JP | 2009-091143 | A | 4/2009 |

* cited by examiner

SHEET FEEDING APPARATUS WITH NIP GUIDE MEMBER

This application is a Continuation of U.S. application Ser. No. 14/146,071, filed on Jan. 2, 2014, and which claims the benefit of Japanese Patent Application No. 2013-003899, filed Jan. 11, 2013, which are hereby incorporated by reference herein in their entireties.

BACKGROUND OF THE INVENTION

Field of the Invention

The present invention relates to a sheet feeding apparatus and an image forming apparatus, and more particularly, to a sheet feeding apparatus having a sheet feeding portion that separates and feeds sheets one by one and an image forming apparatus having the same.

Description of the Related Art

In the related art, there is known an image forming apparatus such as a printer having a sheet feeding apparatus configured to store recoding sheets in a sheet cassette and separates and feeds the stored sheets one by one. This sheet feeding apparatus has a nip guide member that guides a leading end of the sheet to a separator for separating and feeding sheets one by one, and the nip guide member can move as the sheet bundle bumps (refer to Japanese Patent Laid-Open No. 2003-118865).

Hereinafter, a configuration of the sheet feeding apparatus of the related art will be described with reference to FIGS. 18, 19A and 19B. FIGS. 18, 19A and 19B are cross-sectional explanatory diagrams illustrating the sheet feeding apparatus of the related art. FIG. 18 illustrates a state before a feed operation is performed. FIG. 19A illustrates a state when a single sheet S is fed to the separator. FIG. 19B illustrates a state when sheets S are fed to the separator as a bundle.

Referring to FIGS. 18 and 19, the sheet feeding portion has a pickup roller 130 and a pair of separation rollers 134. The pair of separation rollers 134 includes a feed roller 131 and a retard roller 132 arranged to face the feed roller 131. The retard roller 132 is pressurized by a spring (not illustrated) toward the feed roller 131 with a predetermined contact force.

The feed roller 131 is configured to control rotation and stop using a feed clutch (not illustrated). As the feed clutch is turned on, a rotational driving force in a sheet feeding direction (arrow direction "a" in FIG. 18) is transmitted the feed roller 131 via a feed roller shaft 131*a*. A rotational driving force opposite to the sheet feeding direction is transmitted to the retard roller 132 via a torque limiter (not illustrated) supported by the retard roller shaft.

A nip guide member 62 is provided in order to prevent a sheet S from being trapped between a sheet cassette 133 and a pair of separation rollers 134 to generate a jam during a feeding operation. The nip guide member 62 receives a force to approach the feed roller 131 (in the arrow direction "b" in FIG. 18) by a tension spring 64 by setting the rotation shaft 62*b* as a rotation center.

As illustrated in FIG. 18, the nip guide member 62 is positioned by a stopper 63 with a predetermined angle θ (where $0<\theta<90°$) with respect to a feeding direction (the arrow direction "P") of sheets S loaded on a sheet supporting plate 141 which is pushed up by a rotational arm 143. As power is transmitted to the pickup roller 130 and the pair of separation rollers 134 so that the pickup roller 130 abuts on a sheet top surface, and a single sheet S is fed, the sheet S is guided to the separation nip portion N by the nip guide member 62 as illustrated in FIG. 19A.

When a single sheet S is fed, a load is not nearly applied from the sheet S to the guide surface of the nip guide member 62. Therefore, the nip guide member 62 abuts on the stopper 63 without rotation as illustrated in FIG. 19A.

However, the number of sheets S fed by the pickup roller 130 is not limited to one. A plurality of sheets S may be fed from the sheet cassette 133 as a bundle. In this case, a significant load is applied to the nip guide member 62 from a bundle of sheets S. As a result, as illustrated in FIG. 19B, the nip guide member 62 rotates with the rotation shaft 62*b* as a supporting point to recede from the feed roller 131 (the arrow direction "d"). It is noted that a significant load is also applied to the nip guide member 62 if a sheet such as a thick sheet having high rigidity is fed even when a single sheet S is fed from the pickup roller 130.

As the nip guide member 62 rotates in the arrow direction d, an angle θ between the nip guide member 62 and the sheet bundle increases. Therefore, a bundle of sheets S is loosened and guided to the separation nip portion N. It is noted that the sheet separated in the separation nip portion N is fed to a pair of conveying rollers 136 and is conveyed to an image forming portion.

As described above, in the related art, an angle θ between the nip guide member 62 and the sheet S changes depending on whether a single sheet is fed or a bundle of sheets is fed. In addition, if a sheet S having high rigidity such as a thick sheet is fed even when a single sheet S is fed, the angle θ between the nip guide member 62 and the sheet bundle changes. In this manner, as the angle θ changes depending on the number of sheets or stiffness of the sheet, conveyance resistance of the nip guide member 62 for a sheet S also changes.

For example, in the case of a thick sheet having high rigidity or a sheet S having a rough cutting surface, as the conveyance resistance of the nip guide member 62 increases, a sheet leading-end may be trapped in the nip guide member 62 and fail to advance to the downstream side to generate a delay. Recently, there is a high speed tendency in printers. Therefore, if there is a delay in conveyance of a sheet S in a sheet feeding apparatus of a high-speed printer, a jam may occur due to a conveyance delay (a sheet may fail to reach a predetermined location within a predetermined time).

In the technique of the related art, when a bundle of sheets S or a sheet having high rigidity is fed, the nip guide member 62 is retracted, and an abutment point of the sheet leading-end on the circumferential surface of the retard roller 132 changes.

In particular, responding to a miniaturization tendency in recent printers, a diameter of the retard roller tends to decreases. In this case, when the abutment point of a sheet leading-end on the retard roller changes, an abutment angle between the sheet leading-end and the circumferential surface of the retard roller (an acute angle between a tangential line at the abutment point of the sheet leading-end on the retard roller and the sheet) abruptly increases. A circumferential surface of the retard roller has a high frictional coefficient. Therefore, if a sheet leading-end bumps into the retard roller with a large abutment angle, the sheet leading-end may be significantly damaged, or a jam may occur as the sheet leading-end fails to enter the separation nip portion N.

The present invention provides a sheet feeding apparatus and an image forming apparatus capable of reliably separating and feeding sheets one by one to a downstream side without a delay and damage to the sheet in order to respond to a high speed, miniaturization, and applicability to various media of a printer.

SUMMARY OF THE INVENTION

According to an aspect of the invention, there is provided a sheet feeding apparatus including: a conveying roller; a separation member which presses against the conveying roller to form a separation nip portion that separates received sheets one by one; a nip guide member having a sloped guide surface whose guide leading-end receives a force toward the conveying roller in a position distant from the conveying roller with a predetermined distance to slope so as to guide a leading end of a sheet to the separation nip portion; and a support member which supports the nip guide member not to recede from the conveying roller when a thickness of a sheet bundle bumping into the sloped guide surface is smaller than the predetermined distance between the conveying roller and the guide leading-end and supports the nip guide member to recede from the conveying roller when the thickness is larger than the predetermined distance.

According to another aspect of the invention, there is provided a sheet feeding apparatus including: a conveying roller; a separation member which presses against the conveying roller to form a separation nip portion that separates and feeds received sheets one by one to a downstream side; a nip guide member which has a sloped guide surface sloped toward the separation nip portion to guide a leading end of a sheet to the separation nip portion; a biasing member which applies a force such that a guide leading-end of the nip guide member is directed to the conveying roller; and a restricting portion which performs restriction resisting to a biasing force of the biasing member such that the guide leading-end is close to the conveying roller with a predetermined distance, wherein a rotation center of the nip guide member is provided in an area interposed between a first straight line extending opposite to the conveying roller and perpendicularly to the sloped guide surface and a second straight line that connects a rotation center of the conveying roller and the guide leading-end in an abutment portion where a leading end of a fed sheet abuts on the sloped guide surface.

According to still another aspect of the invention, there is provided a sheet feeding apparatus including: a conveying roller; a separation member which presses against the conveying roller to form a separation nip portion that separates and feeds received sheets one by one to a downstream side; a nip guide member which has a sloped guide surface sloped toward the separation nip portion to guide a leading end of a sheet to the separation nip portion; a biasing member which applies a force such that a guide leading-end of the nip guide member is directed to the conveying roller; and a restricting portion which performs restriction resisting to a biasing force of the biasing member such that the guide leading-end is close to the conveying roller with a predetermined distance, wherein a rotation center of the nip guide member is provided in an area interposed between a first straight line extending opposite to the separation member and perpendicularly to the sloped guide surface and a second straight line that connects a rotation center of the conveying roller and the guide leading-end in an abutment portion where a leading end of a fed sheet abuts on the sloped guide surface.

According to the present invention, responding to a high speed, miniaturization, and applicability to various media of a printer, it is possible to reliably separate and feed sheets one by one to the downstream side without a delay and damage to a sheet.

Further features of the present invention will become apparent from the following description of exemplary embodiments with reference to the attached drawings.

DESCRIPTION OF THE EMBODIMENTS

First Embodiment

Figure 2:
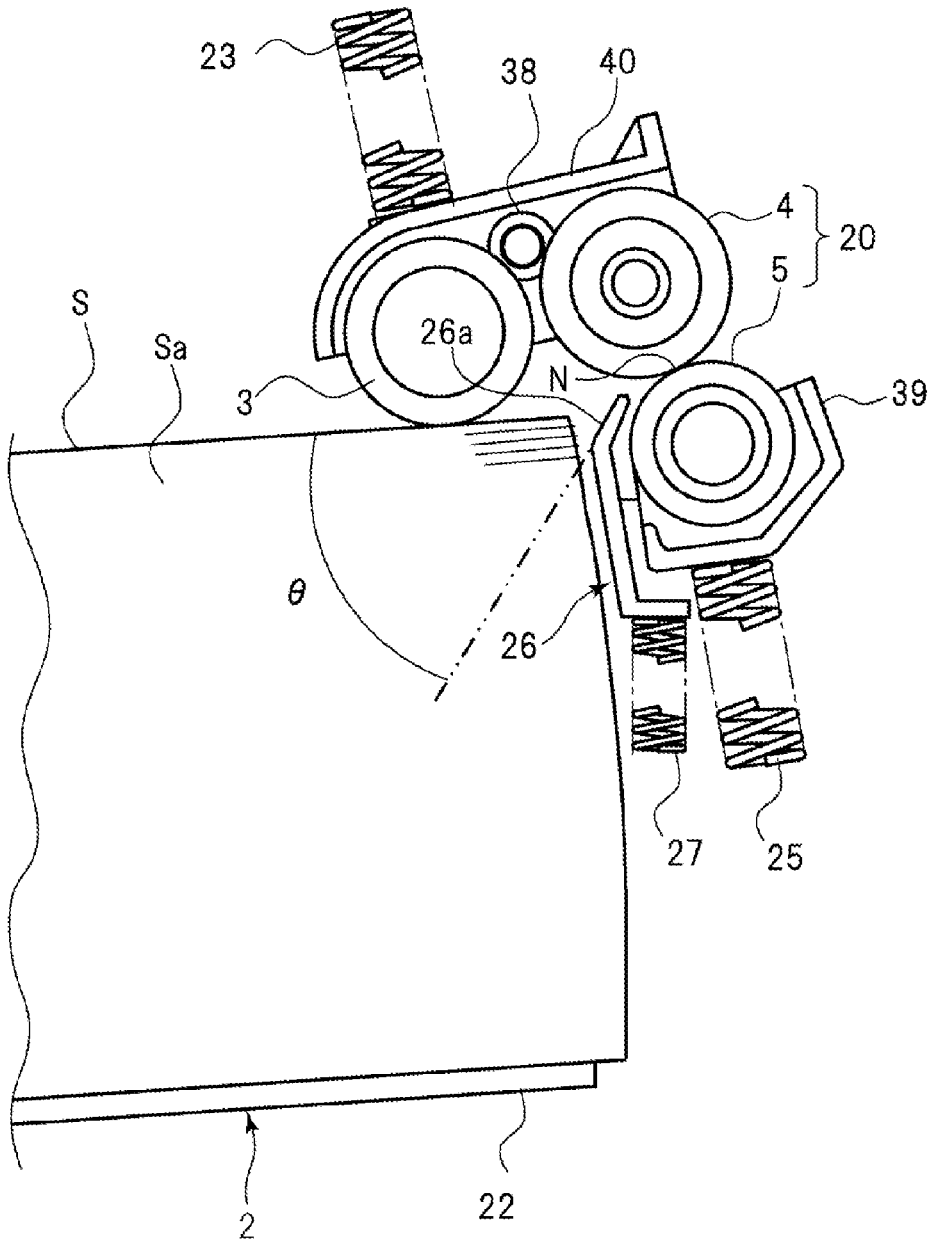
FIG. 2 is a schematic front cross-sectional view illustrating the sheet feeding portion according to the first embodiment.
Figure 3:
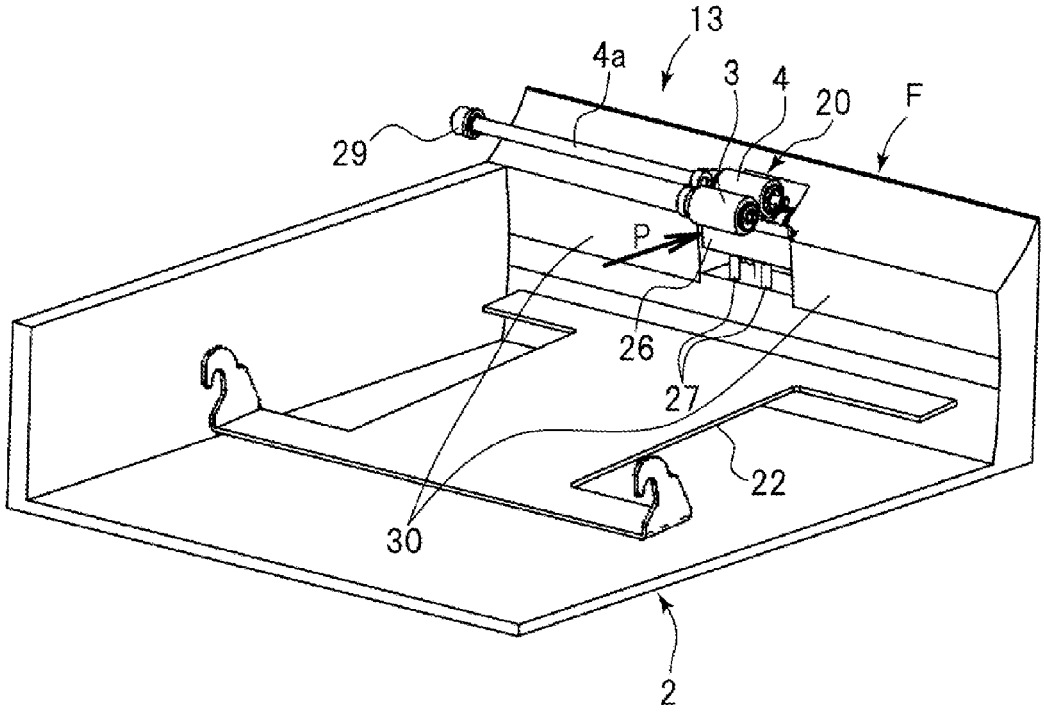
FIG. 3 is a perspective view illustrating the sheet feeding portion according to the first embodiment.
Figure 4:
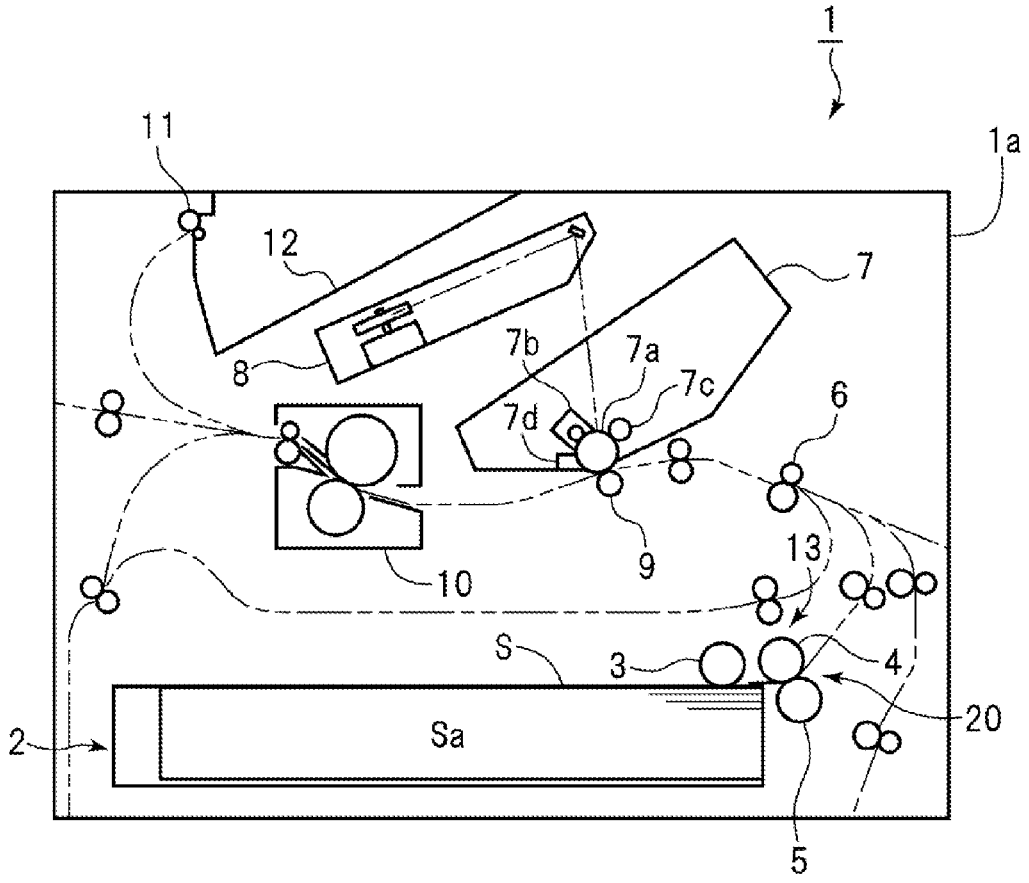
FIG. 4 is a schematic diagram illustrating a printer attaching the sheet feeding portion according to the first embodiment.

Hereinafter, an image forming apparatus such as a laser beam printer (hereinafter, referred to as a "printer") and a sheet feeding portion as a sheet feeding apparatus mounted on the image forming apparatus according to an embodiment of the invention will be exemplarily described with reference to FIGS. 1 to 10. FIG. 4 is a front view schematically illustrating the entire image forming apparatus mounting the sheet feeding portion.

As illustrated in FIG. 4, the image forming apparatus 1 such as a printer has a main body 1*a*. The main body 1*a* has a sheet feeding portion 13 as a sheet feeding apparatus that separates and feeds sheets S one by one to the image forming portion described below.

In the apparatus main body 1*a*, a process cartridge 7 internally provided with a process unit well-known for image formation is arranged detachably attachable over the sheet feeding portion 13. Inside the process cartridge 7, a photosensitive drum 7*a* as an image bearing member is embedded. In the photosensitive drum 7*a*, an image is written by irradiating laser light from a laser exposure device 8 based on image information.

A transfer roller 9 is pressed onto the photosensitive drum 7*a*. A toner image formed on a surface of the photosensitive drum 7*a* is transferred to the sheet S fed from the sheet feeding portion 13 when it passes through a transfer portion between the photosensitive drum 7*a* and the transfer roller 9. It is noted that the process cartridge 7, the laser exposure device 8, and the transfer roller 9 constitute an image forming portion for forming an image on a sheet S fed from the sheet feeding portion 13.

A fixing device 10 is arranged in the downstream side of the transfer portion. The fixing device 10 applies heat and pressure to the sheet S subjected to the image transfer to fix the toner image transferred onto the sheet S. Then, the sheet S subjected to the image fixation is conveyed and discharged by a pair of discharge rollers 11 to a discharge tray 12 provided in an upper surface of the apparatus while an image surface faces the ground. Referring to FIG. 4, a pair of conveying rollers 6, a charging unit 7*b*, a development device 7*c*, and a cleaner 7*d* are also arranged.

Figure 1:
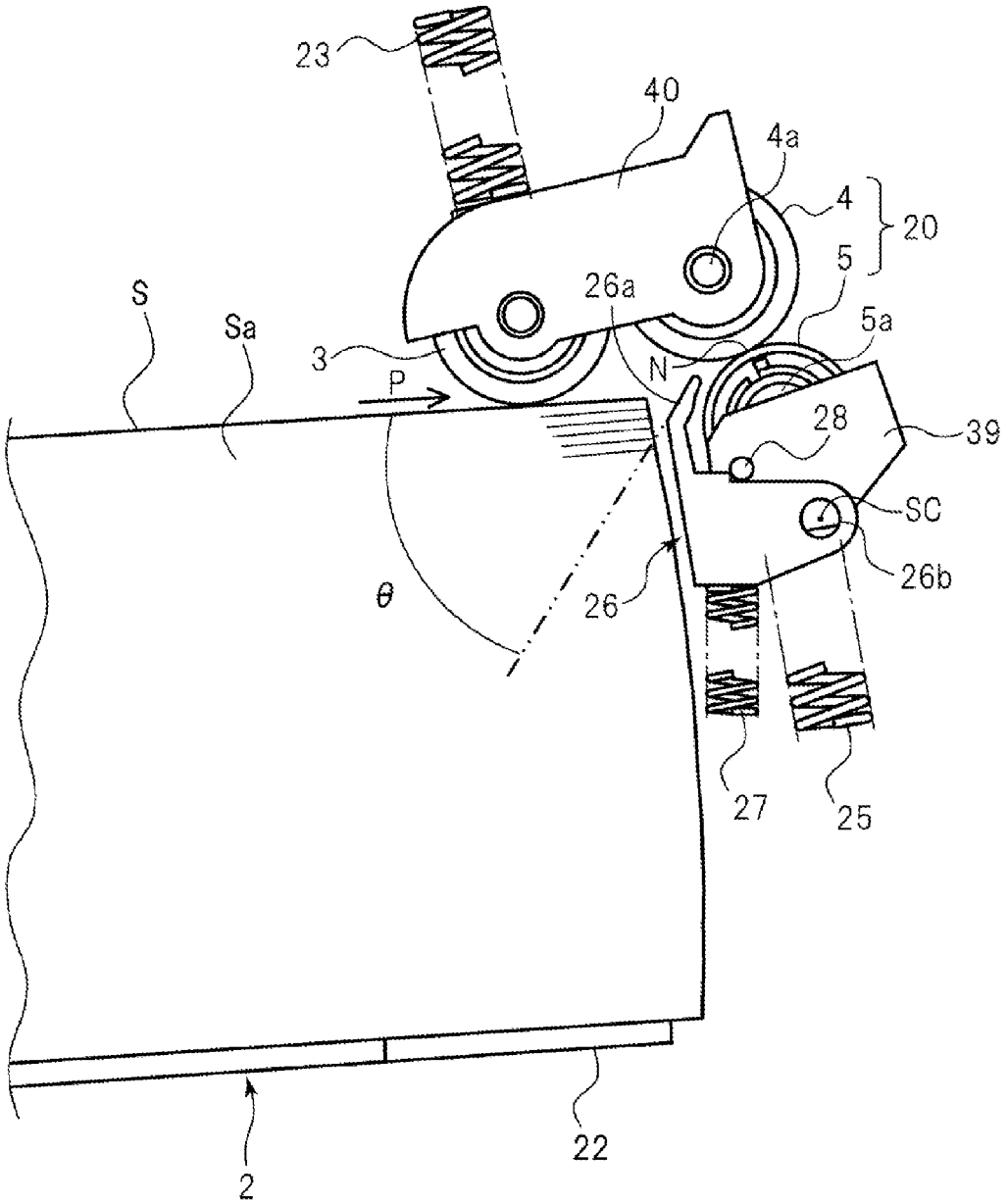
FIG. 1 is a schematic front view illustrating a sheet feeding portion according to a first embodiment of the invention.

Next, a sheet feeding portion 13 as a sheet feeding apparatus will be described in more detail with reference to FIGS. 1 to 3. FIG. 1 is a schematic front view illustrating the sheet feeding portion 13 of first embodiment, FIG. 2 is a schematic front cross-sectional view illustrating the sheet feeding portion 13, and FIG. 3 is a perspective view illustrating the sheet feeding portion 13.

The sheet feeding portion 13 includes a sheet cassette 2 capable of loading and storing a sheet bundle Sa and configured detachably attachable to the apparatus main body 1*a*, a pickup roller 3 serving as a feed member, and a pair of separation rollers 20. A pair of separation rollers 20 includes a feed roller 4 serving as a conveying member and a retard roller 5 serving as a separation member arranged to face the feed roller 4. The retard roller 5 is pressurized onto a feed roller 4 by a spring (not illustrated) with a predetermined contact force at all times.

The sheet cassette 2 has a cassette frame F and a sheet supporting plate 22 in the cassette frame. The sheet supporting plate 22 loads a sheet bundle Sa which is arranged such that an upstream side serves as a rotation supporting point, and a downstream side can be lifted and lowered. In addition, the upstream side of the sheet supporting plate 22 is lifted to cause the uppermost sheet S of the loaded sheet bundle Sa to abut on the pickup roller 3, and the uppermost sheet S is fed by rotating the pickup roller 3.

A pair of separation rollers 20 includes a feed roller 4 and a retard roller 5 arranged to face the feed roller 4. An electromagnetic clutch 29 is installed in an end portion of a feed roller shaft 4*a* that supports the feed roller 4 in FIG. 3, and the electromagnetic clutch 29 receives rotation from a motor (not illustrated). In addition, the electromagnetic clutch 29 controls rotation and interruption of the feed roller 4. The feed roller 4 transmits a rotational driving force in a direction where a sheet S is fed (counterclockwise in FIG. 1) with respect to the feed roller shaft 4*a* as a rotation center as the electromagnetic clutch 29 is turned on.

A retard roller shaft 5*a* is installed in a holder 39 vertically slid movably or pivotably supported, and the retard roller 5 is supported by the retard roller shaft 5*a*. In addition, a torque limiter (not illustrated) is provided between the retard roller 5 and the retard roller shaft 5*a*. The retard roller 5 is pressurized to the feed roller 4 with a predetermined contact pressure as the holder 39 receives a force upwardly applied by the compression spring 25.

The pickup roller 3 is supported by a holder 40 rotatably supported by the feed roller shaft 4*a* as a supporting point that supports the feed roller 4. In addition, the pickup roller 3 is configured to receive rotation from the feed roller 4 via an idler gear 38 interposed between the pickup roller 3 and the feed roller 4 as illustrated in FIG. 2. Furthermore, the pickup roller 3 rotates counterclockwise in FIG. 2 to feed a sheet as the electromagnetic clutch 29 is turned on at a predetermined feeding timing. The sheet S fed by the pickup roller 3 is separated one by one in the separation nip portion N pressed against by the feed roller 4 and the retard roller 5 and is fed to the downstream side.

A nip guide member 26 for smoothly guiding a sheet S to the separation nip portion N of a pair of separation rollers 20 is arranged between the pickup roller 3 and a pair of separation rollers 20. The nip guide member 26 receives a force to a stopper (restricting member) 28 that restricts a guide leading-end 26*c* located between the pickup roller 3 and the separation nip portion N to be close to the feed roller 4 by a predetermined distance h (FIG. 6) (distant from the feed roller 4 by a predetermined distance). The nip guide member 26 has a sloped guide surface 26*a* that has an approximately planar shape and is sloped toward the separation nip portion N to guide a leading end of a sheet S to the separation nip portion N. The stopper 28 is provided on a flame F of the sheet cassette 2.

Specifically, the leading end of the nip guide member 26 has the sloped guide surface 26*a* for guiding a sheet bundle to the separation nip portion N while the sheet bundle is loosened in a wedge shape (by deviating a leading end with a slope). The nip guide member 26 is rotatably supported while the rotation shaft 26*b* is used as rotation supporting point. The shaft 26*b* is provided on the cassette frame F of the sheet cassette 2. The nip guide member 26 receives a force from a pair of compression springs 27 (refer to FIG. 3) as a biasing member arranged in a width direction perpendicular to the sheet feeding direction such that the guide leading-end 26*c* of the sloped guide surface 26*a* approaches the feed roller 4 (clockwise rotation in FIG. 1).

The nip guide member 26 abuts on the stopper 28 serving as a restricting member such that the sloped guide surface 26*a* has a predetermined angle ($30° < \theta < 70°$ in this embodiment) with respect to a direction where a sheet S is fed (hereinafter, referred to as a sheet feeding direction P). As the nip guide member 26 abuts on the stopper 28, rotation is restricted such that the nip guide member 26 is prevented from further approaching the feed roller 4.

The predetermined angle θ changes as the loading amount of sheet bundle Sa loaded on the sheet cassette 2 changes. This predetermined angle θ is set such that a leading end of a sheet S is not trapped even when various types of sheets are fed regardless of strength of rigidity of a sheet S, degree of roughness of a cutting surface, a high frictional coefficient of a surface, and the like.

Figure 6:
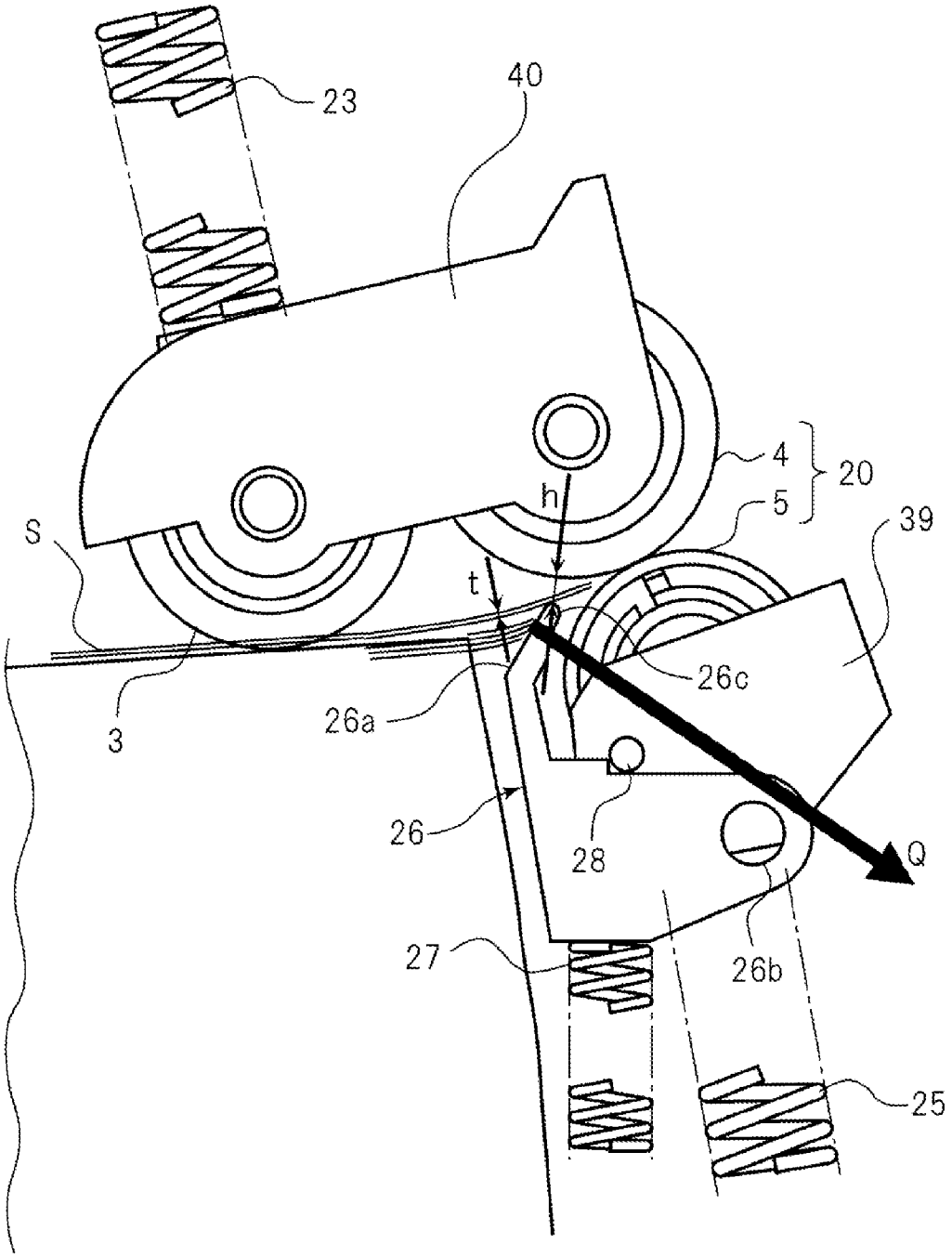
FIG. 6 is a front view illustrating a sheet feeding portion according to the first embodiment.

It is noted that the rotation shaft 26*b* and the compression spring 27 constitute a support member. The support member supports the nip guide member 26 such that the nip guide member 26 does not recede from the feed roller 4 when the thickness t (FIG. 6) is smaller than a predetermined length h, and the nip guide member 26 recedes from the feed roller 4 when the thickness t (FIG. 6) is larger than the predetermined length h. The aforementioned thickness t refers to a thickness of the sheet S bumping into the sloped guide surface 26*a* from the pickup roller 3. The predetermined distance h refers to a distance between the feed roller 4 and the guide leading-end 26*c* (FIG. 6).

The electromagnetic clutch 29 is turned on at a predetermined feed timing when a sheet is fed, so that a rotational driving force provided from a driving source (not illustrated) is transmitted to the feed roller 4. As a result, the feed roller 4 is rotated counterclockwise in FIG. 2.

A plurality of sheets S fed by the pickup roller 3 can be loaded on the sheet cassette 2. The sheet cassette 2 has a sheet storage portion having a restricting wall surface 30 for regulating leading ends of the loaded sheets in a feeding direction. The restricting wall surface 30 is arranged in a side close to the sheet S inside the sheet cassette 2 (inside the sheet storing portion) relative to the nip guide member 26. A positional relationship between the restricting wall surface 30 and the nip guide member 26 may be similarly applied to second to fourth embodiments described below.

Next, a series of feeding operations of the sheet feeding portion 13 will be described with reference to FIGS. 4 to 10.

Specifically, a sheet bundle Sa is loaded on the sheet cassette 2, and the sheet cassette 2 is installed in the apparatus main body 1*a*, the sheet supporting plate 22 is lifted, and the uppermost sheet S of the sheet bundle Sa moves to a predetermined height. The pickup roller 3 receives a force applied to the sheet cassette 2 side from the compression spring 23 so that the uppermost sheet S abuts on the pickup roller 3 with a predetermined pressure.

As a feeding signal is transmitted from the apparatus main body 1*a*, a driving source (not illustrated) is driven such that the electromagnetic clutch 29 is turned on at a predetermined feed timing. As a result, the feed roller 4 and the pickup roller 3 rotate counterclockwise so that the uppermost sheet S of the sheet bundle Sa starts moving toward the nip guide member 26.

Figure 5:
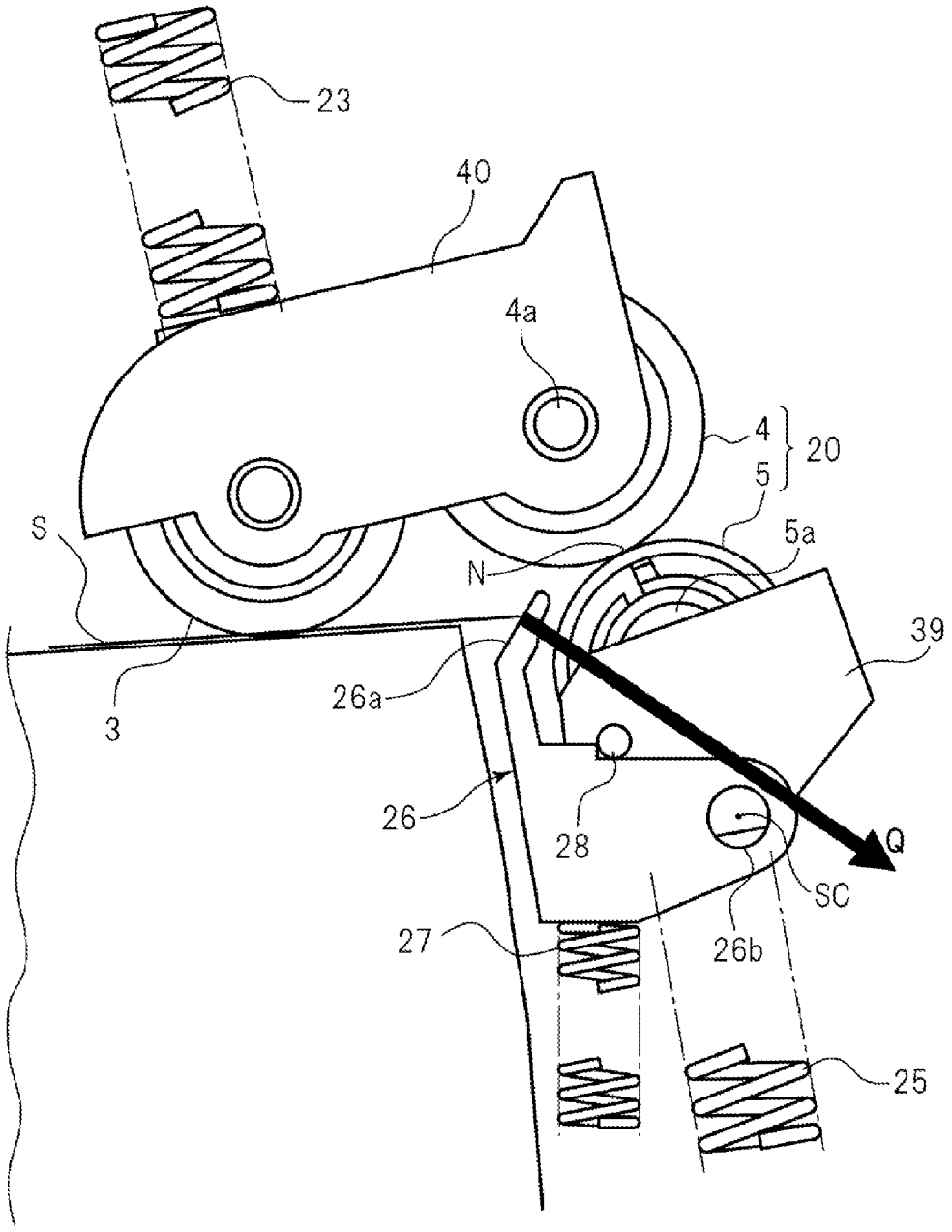
FIG. 5 is a front view illustrating the sheet feeding portion according to the first embodiment.

Here, both the case where a single sheet S of the sheet bundle Sa is fed by the pickup roller 3 and the case where a plurality of sheets S is fed will be described with reference to FIGS. 5 to 7. FIGS. 5 to 7 are explanatory diagrams illustrating the sheet feeding portion in detail.

As illustrated in FIG. 5, when sheets S are fed one by one, the leading end of the sheet is fed to the separation nip portion N along the sloped guide surface 26*a* of the nip guide member 26. When the sheet S has high rigidity such as a thick sheet, a bumping force of the leading end of the sheet S to the sloped guide surface 26*a* caused by the pickup roller 3 is high. For this reason, the nip guide member 26 receives a pressing force in the arrow direction Q and is applied a force to rotate clockwise with the rotation shaft 26*b* as a supporting point. However, the clockwise rotation of the nip guide member 26 is restricted by the stopper 28.

Therefore, even when various types of sheets are fed, a posture of the nip guide member 26 does not change, and a sheet S is consistently guided to the separation nip portion N by the nip guide member 26 at all times. In addition, when a single sheet S is fed to the separation nip portion N, a torque limiter (not illustrated) connected to the retard roller 5 is idled by a frictional force between the feed roller 4, the sheet S, and the retard roller 5. As a result, the retard roller 5 co-rotates the sheet S fed in the sheet feeding direction (refer to FIG. 1) (driven rotation) to feed the sheet S to the downstream side. In addition, when a plurality of sheets S is fed as a bundle by the pickup roller 3, two cases can be assumed as described below.

As a first case, as illustrated in FIG. 6, a bundle of sheets S is loosened in a wedge shape by the sloped guide surface 26*a* of the nip guide member 26, and several upper sheets of the sheet bundle Sa are conveyed to the separation nip portion N over the sloped guide surface 26*a*. Specifically, in this case, assuming that "h" denotes the closest distance (predetermined distance) between the sloped guide surface 26*a* and the feed roller 4, a thickness t of the sheet S surpassing the sloped guide surface 26*a* is set to "t<h".

In this case, as a sheet bundle Sa bumps, the nip guide member 26 receives a force in the arrow direction Q and is applied a force to rotate clockwise with the rotation shaft 26*b* as a supporting point. However, the position of the nip guide member 26 is restricted by the stopper 28. In addition, as several sheets surpassing the sloped guide surface 26*a* reaches the separation nip portion N, it is possible to separate a bundle of sheets S one by one without rotating the retard roller 5 because a frictional force between sheets S is weaker than a load of the torque limiter (not illustrated).

As a result, only the uppermost sheet S making contact with the feed roller 4 out of a plurality of the fed sheets S is conveyed to the downstream side, and the remaining sheets S are blocked by the retard roller 5 remaining stationary and stay in the separation nip portion N.

Figure 7A:
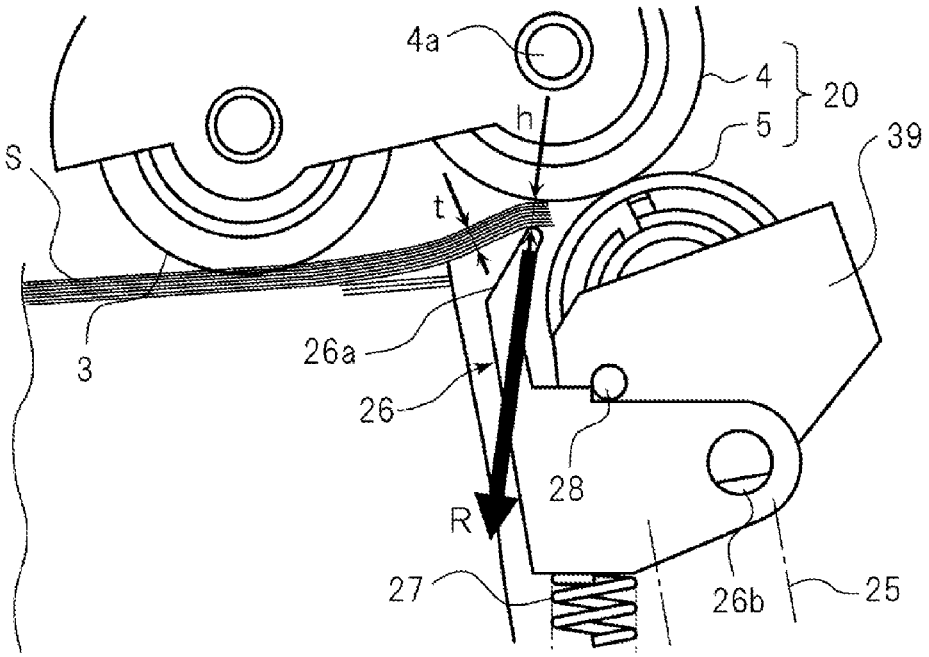
FIGS. 7A and 7B are front views illustrating the sheet feeding portion according to the first embodiment.

As a second case, as illustrated in FIG. 7A, a bundle of sheets S surpasses the sloped guide surface 26*a* as it is without being loosened by the sloped guide surface 26*a*. Specifically, in this case, a relationship between the thickness t of the bundle of sheets S and the closest distance h between the sloped guide surface 26*a* and the feed roller 4 is set to "t h".

Figure 7B:
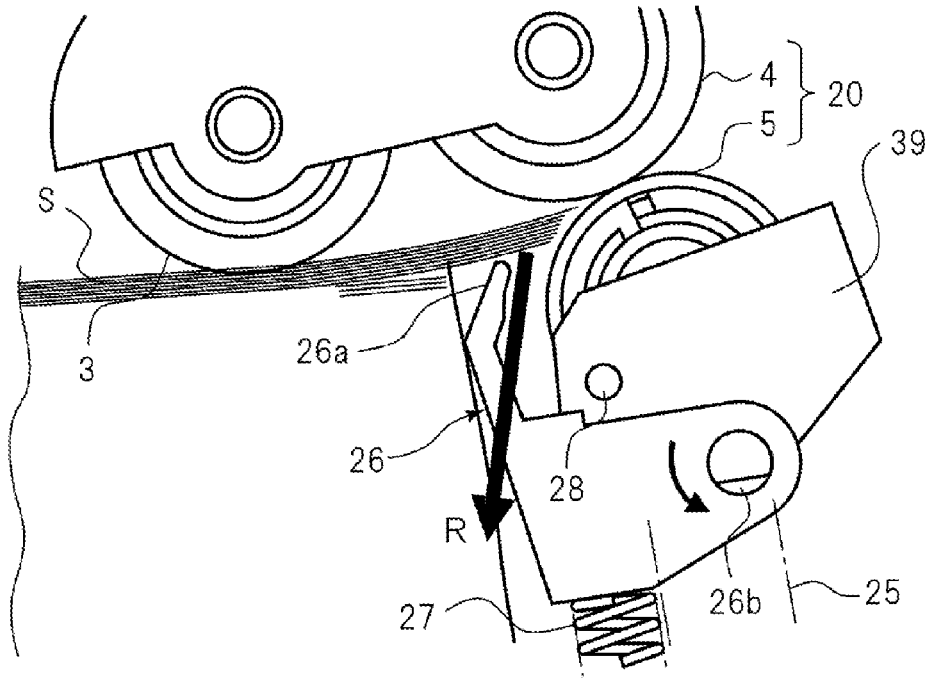

In this case, a bundle of sheets S is nipped between the top (apex) of the sloped guide surface 26*a* and the feed roller 4. Then, a reactive force of the nipping force is generated in the nip guide member 26 in the arrow direction R. In addition, as illustrated in FIG. 7B, the nip guide member 26 is rotated with respect to the rotation shaft 26*b* by the reactive force in the arrow direction R to recede from the feed roller (counterclockwise) resisting to the pressurizing force of the compression spring (biasing member) 27. As the nip guide member 26 rotates counterclockwise in this manner, a nipping force applied to a bundle of sheets S by the nip guide member 26 and the feed roller 4 is generated only by the spring pressure of the compression spring 27.

As a result, the nipping force applied to a bundle of sheets S is reduced. In addition, when a bundle of sheets S reaches the separation nip portion N as it is, a frictional force between sheets S is weaker than the load of the torque limiter. Therefore, it is possible to loosen the bundle of sheets S without rotating the retard roller 5. Accordingly, only the uppermost sheet of the sheet bundle is conveyed to the downstream side.

In order to rotate (retract) the nip guide member 26 in this manner when a bundle of sheets S is nipped between the feed roller 4 and the guide leading-end 26*c* (FIG. 6) on top of the sloped guide surface 26*a* without being loosened in a wedge shape, a configuration condition is defined as follows.

Figure 8:
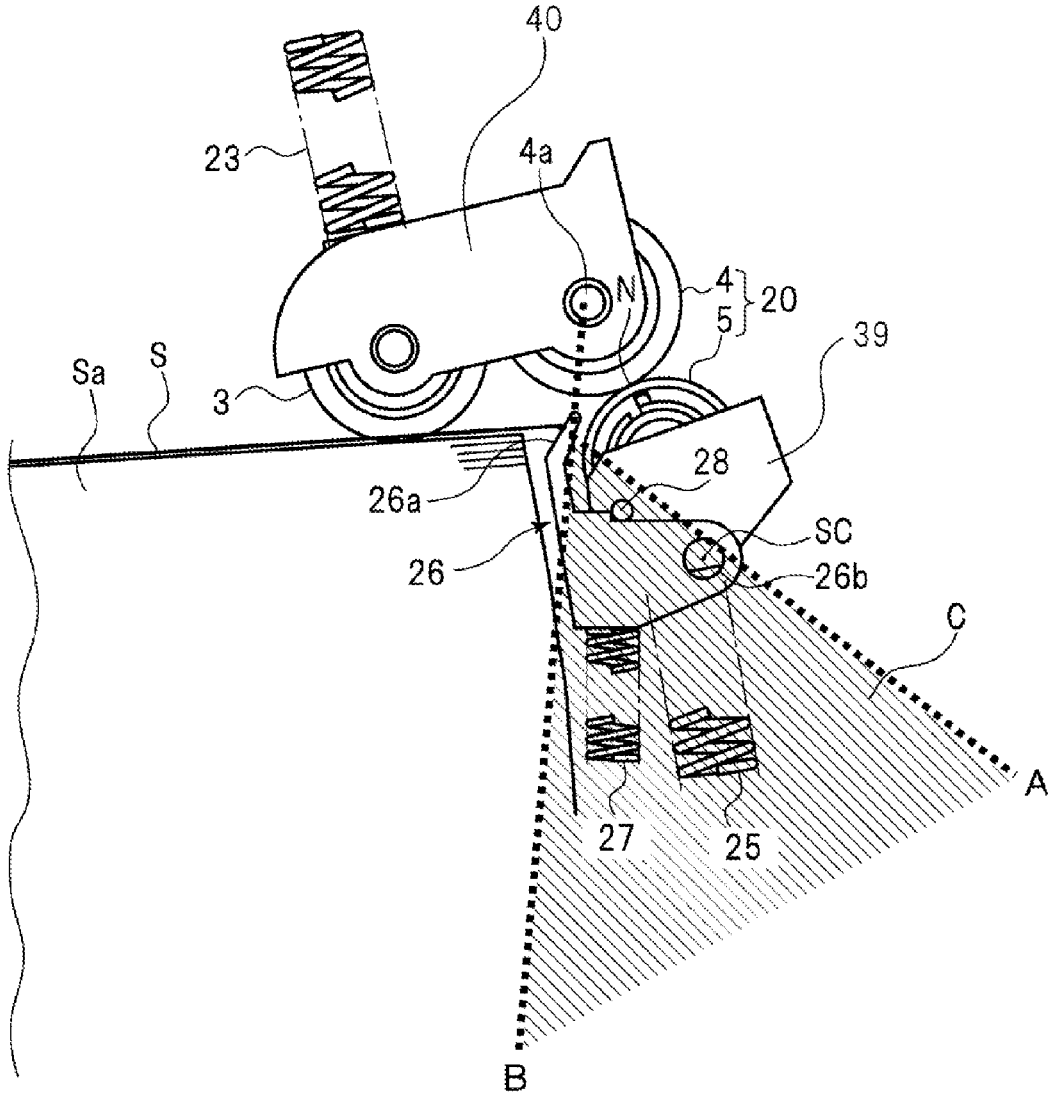
FIG. 8 is a front view illustrating the sheet feeding portion according to the first embodiment.

The rotation shaft 26*b* of the nip guide member 26 is positioned as illustrated in FIG. 8 which is a detailed explanatory diagram of the sheet feeding portion. This will be described in detail. It is noted that the stopper 28 is intentionally omitted in FIG. 8 for convenient description purposes.

The nip guide member 26 is rotatably supported by the support member (including the rotation shaft 26*b* and the compression spring 27), and the first embodiment is characterized in the position of the rotation shaft 26*b* of the support member. The shaft center SC (rotation center) of the rotation shaft 26*b* is arranged in an area C interposed between first and second straight lines A and B (indicated by the hatching area). The first straight line A is a line extending opposite to the pickup roller 3 and perpendicularly to the sloped guide surface 26*a* in an abutment portion where the leading end of the sheet S fed from the pickup roller 3 abuts on the sloped guide surface 26*a*. The second straight line B is a line extending to connect a feed roller shaft 4*a* of the feed roller 4 and the guide leading-end 26*c* closest to the feed roller 4. In addition, it is a condition that the area C where the feed roller shaft 4*a* of the feed roller 4 is located includes the first straight line A (laid on the first straight line) and does not include the second straight line B (is not laid on the second straight line).

The nip guide member 26 is positioned such that the nip guide member 26 does not project from the restricting wall surface 30 (FIG. 3) of the downstream side of the sheet cassette 2 toward the sheet bundle Sa loaded on the sheet cassette 2 (left side in FIG. 8) when the nip guide member 26 is rotated. If the nip guide member 26 projects from the restricting wall surface 30 of the sheet cassette 2 toward the sheet bundle Sa, it obstructs a lifting and lowering of a sheet S in the sheet supporting plate 22 (refer to FIG. 2). In this case, it may damage a sheet S and hinder a sheet S from abutting on the pickup roller 3 with a predetermined pressure.

In this regard, the case where a position of the shaft center SC of the rotation shaft 26*b* of the nip guide member 26 is arranged in the area C of FIG. 8 and the case where it is not arranged in the area C will be described with reference to FIGS. 9A, 9B, 10A, and 10B. FIGS. 9A, 9B, 10A, and 10B illustrate a sheet feeding portion in the related art, in which the position of the shaft center SC of the rotation shaft 26*b* is not arranged in the area C.

In FIG. 9, a description will be made for the sheet feeding portion configured such that the rotation shaft 31*b* which rotatably supports the nip guide member 31 is positioned over the first straight line A described above. The rotation shaft 31*b* is provided on the cassette frame F of the sheet cassette 2.

Figure 9A:
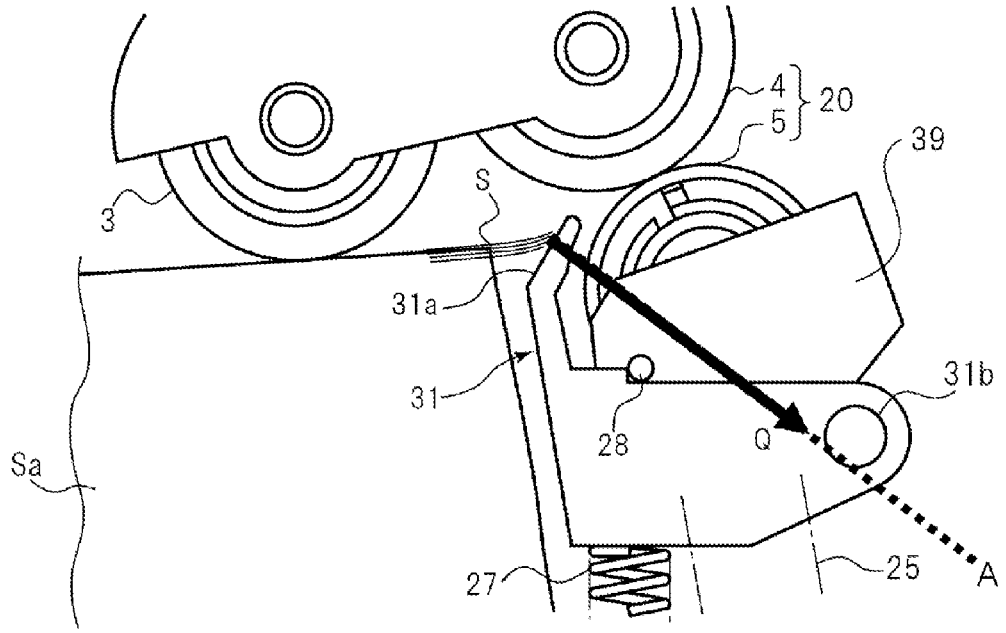
FIGS. 9A and 9B are front views illustrating a sheet feeding portion according to a comparative example.
Figure 9B:
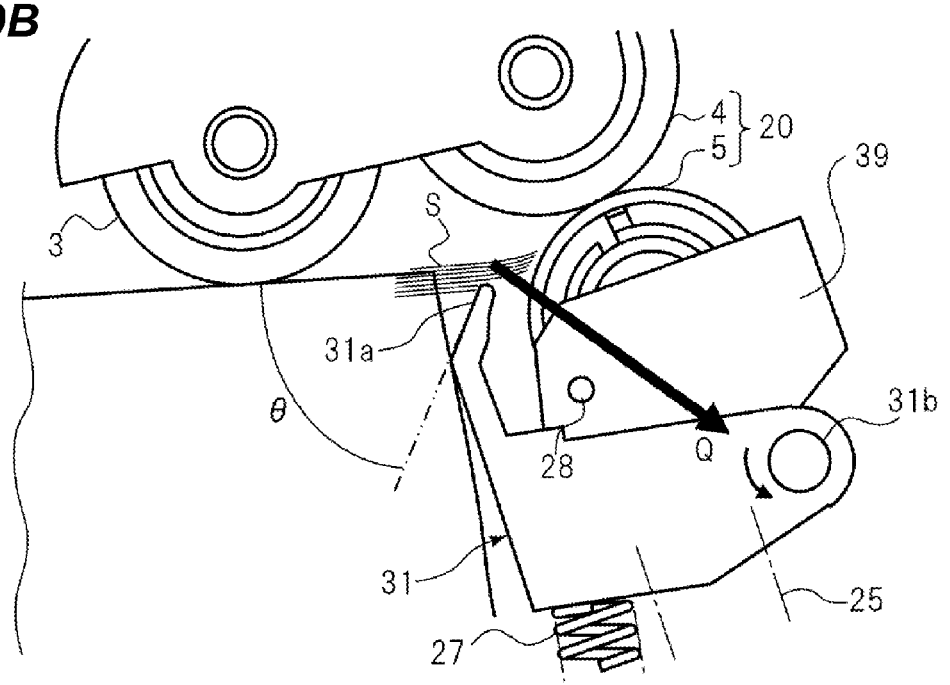

Specifically, when a bundle of sheets S bumps into the sloped guide surface 31*a* of the nip guide member 31, the nip guide member 31 receives a force Q in a direction perpendicular to the sloped guide surface 31*a* from the bundle of sheets S as illustrated in FIG. 9A. Then, as illustrated in FIG. 9B, the nip guide member 31 is rotated counterclockwise with the rotation shaft 31*b* as a supporting point to recede from the feed roller 4 resisting to a biasing force of the compression spring 27 by a rotational moment. Then, a predetermined angle θ between the sloped guide surface 31*a* of the nip guide member 31 and the uppermost sheet S increases compared to the configuration of FIG. 8, and conveyance resistance of the sloped guide surface 31*a* against a sheet S increases.

In this configuration, when a thick sheet having high rigidity or a sheet having a rough cutting surface is fed, a leading end of a sheet may be trapped in the sloped guide surface 31*a* so that a conveyance timing is delayed, or a jam may occur as the sheet fails to further advance to the downstream side. In addition, since the retard roller 5 further projects from the nip guide member 31, a curvature increases in a position where a leading end of a sheet bumps into the retard roller 5, and an abutment angle of a leading end of a sheet on the retard roller 5 increases. As a result, a thin sheet having low rigidity may be damaged in a leading end of the sheet, or a jam may occur as the sheet fails to further advance toward the downstream side.

A sheet feeding portion having a configuration in which the rotation shaft 32*b* which rotatably supports the nip guide member 32 is positioned in the left side of the second straight line (refer to FIG. 8) will be described with reference to FIG. 10. The rotation shaft 32*b* is provided on the cassette frame F of the sheet cassette 2.

Figure 10A:
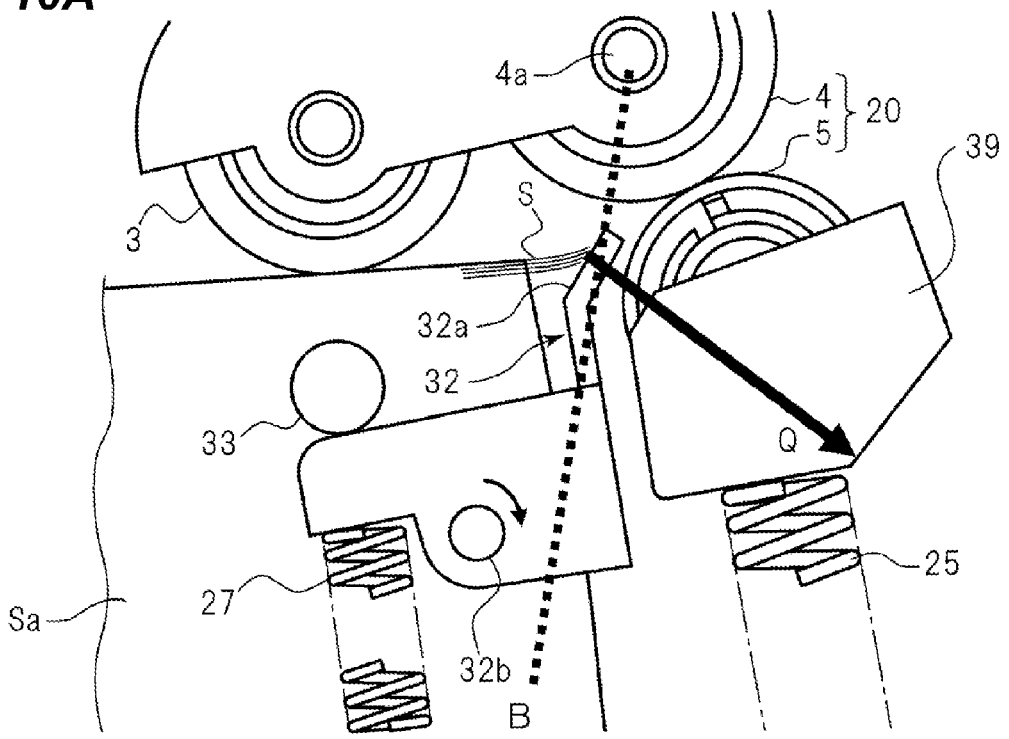
FIGS. 10A and 10B are front views illustrating a sheet feeding portion according to a comparative example.

Specifically, when a bundle of sheets S bumps into the sloped guide surface 32*a* of the nip guide member 32, the nip guide member 32 receives a force Q in a direction perpendicular to the sloped guide surface 32*a* from a bundle of sheets S as illustrated in FIG. 10A. As a result, while the nip guide member 32 is applied a force to rotate clockwise with the rotation shaft 32*b* as a supporting point positioned in the sheet bundle Sa side, it fails to rotate due to restriction of a stopper 33. The stopper 33 is provided in a position where clockwise rotation of the nip guide member 32 is restricted in a side opposite to the stopper 28 of FIG. 9 with respect to the second straight line B. The stopper 33 is provided on a flame F of the sheet cassette 2.

Figure 10B:
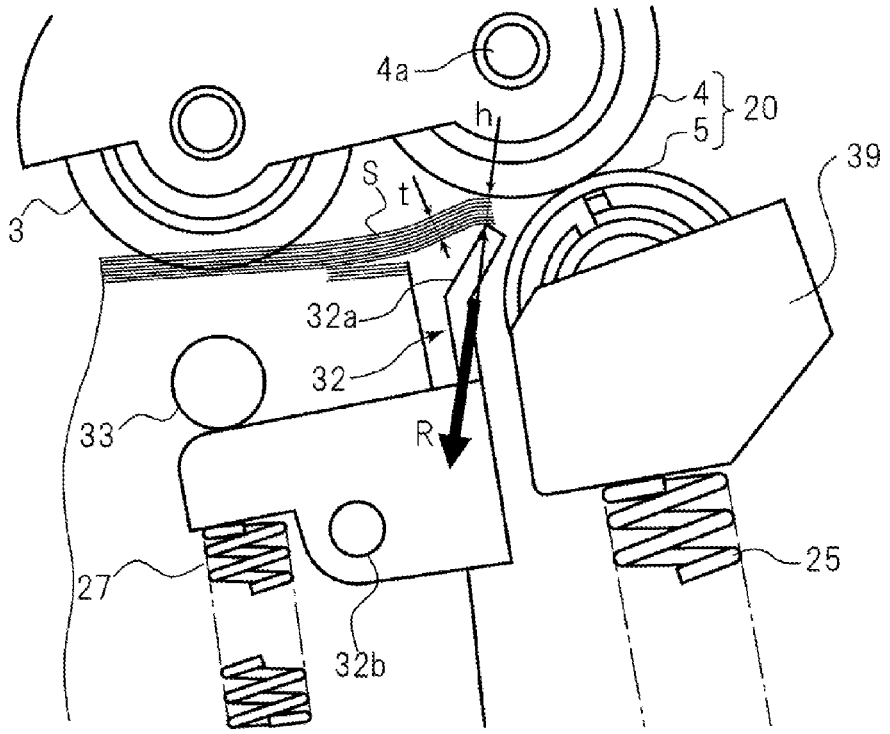

Referring to FIG. 10B, if a bundle of sheets S surpasses the sloped guide surface 32*a* as it is, and a thickness t of the bundle of sheets S and a predetermined distance h where the sloped guide surface 32*a* is closest to the sloped guide surface 32*a* have a relationship "t≥h", a force of nipping the sheet bundle is applied between the apex of the sloped guide surface 32*a* and the feed roller 4.

Since a reactive force of the nipping force is applied to the nip guide member 32 in the arrow direction R, the nip guide member 32 is applied a force to rotate clockwise with the rotation shaft 32*b* as a supporting point to recede from the feed roller 4. However, the nip guide member 32 fails to rotate due to restriction of the stopper 33. In addition, while the nipping force between the apex of the sloped guide surface 32*a* and the feed roller 4 is applied to a sheet S, each bundle of sheets S is conveyed to the separation nip portion N by rotation of the feed roller 4.

If each bundle of sheets is conveyed in a nipped state in this manner, a large pressure is vertically applied to the sheet bundle, and a frictional force between sheets increases compared to the load of the torque limiter. Therefore, the retard roller 5 co-rotates as the sheet S moves (driven rotation). Accordingly, a bundle of sheets S is conveyed to the downstream side as it is without being loosened, so that the sheets are overlappingly conveyed.

As described above, in the sheet feeding portion 13 of first embodiment, the rotation shaft 26*b* of the nip guide member 26 is provided in the area C (FIG. 8). Therefore, it is possible to reliably separate and feed each sheet of a sheet bundle Sa in the sheet cassette 2 without damage at a predetermined timing.

While the sheet feeding portion 13 having the pickup roller 3, the feed roller 4, and the retard roller 5 has been exemplarily described in the first embodiment, the same effect can also be obtained using the following feeding method. Specifically, a single feeding roller may be used as the pickup roller and the feed roller, or a retard feeding method may be employed, in which a driving force is transmitted such that the retard roller rotates in a direction opposite to the sheet feeding direction. In addition, sheets may be separated using a non-rotating member such as a separation pad instead of the retard roller as a separation member. Furthermore, the same effect can also be obtained using a sheet feeding apparatus that does not have a sheet cassette for storing a sheet bundle or a lifting and lowering sheet supporting plate for loading a sheet bundle. This may similarly apply to second to fourth embodiments described below.

As described above, according to the first embodiment, when various types of sheets bump into the sloped guide surface 26*a* of the nip guide member 26, it is possible to stably guide the sheet S to the separation nip portion N without moving the nip guide member 26 regardless of a single sheet or a bundle of sheets.

When a bundle of sheets advances as it is and is nipped between the top (apex) of the nip guide member 26 and the feed roller 4, the nip guide member 26 is retracted. As a result, it is possible to prevent overlapping conveyance caused by performing conveyance while a bundle of sheets S is nipped between the leading end of the nip guide member 26 and the feed roller 4.

Finally, responding to a high speed, miniaturization, and applicability to various media of the image forming apparatus 1 such as a printer, it is possible to reliably separate and feed sheets one by one to the image forming portions 7, 8, and 9 in the downstream side without a delay and damage to a sheet.

Second Embodiment

Figure 11:
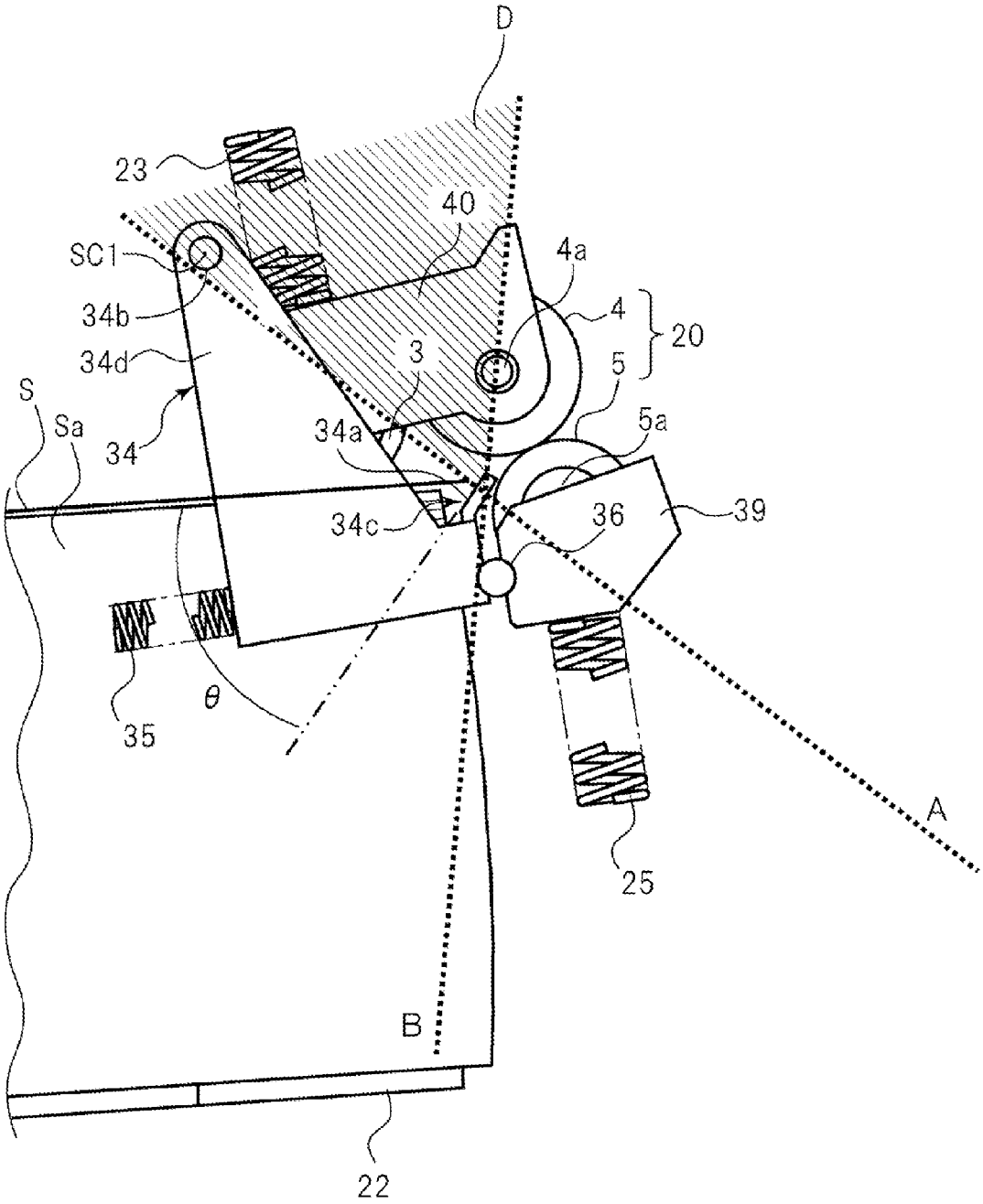
FIG. 11 is a front view illustrating a sheet feeding portion according to a second embodiment of the invention.

Next, a second embodiment of the invention will be described with reference to FIGS. 11 to 13. FIGS. 11 and 13 are front views illustrating a part of a sheet feeding portion of second embodiment, and FIG. 12 is a perspective view illustrating the sheet feeding portion of the second embodiment.

Similar to the first embodiment, according to the second embodiment, a sheet feeding portion 13 (FIG. 12) as a sheet feeding apparatus mounted on an image forming apparatus such as a printer will be exemplarily described. In the sheet feeding portion 13 of second embodiment, like reference numerals denote like elements as in the sheet feeding portion 13 of the first embodiment, and descriptions thereof will not be repeated.

Referring to FIG. 11, a nip guide member 34 is rotatably supported by the rotation shaft 34*b* which is provided on the cassette frame F of the sheet cassette 2. The nip guide member 34 includes a rotation shaft 34*b* and a sloped guide surface 34*a* approximately planar. The nip guide member 34 receives a force toward a stopper (restricting member) 36 from a single compression spring 35 and is arranged such that the sloped guide surface 34*a* has a predetermined angle θ with a sheet S fed by a pickup roller 3. The stopper 36 is provided on a flame F of the sheet cassette 2.

Figure 12:
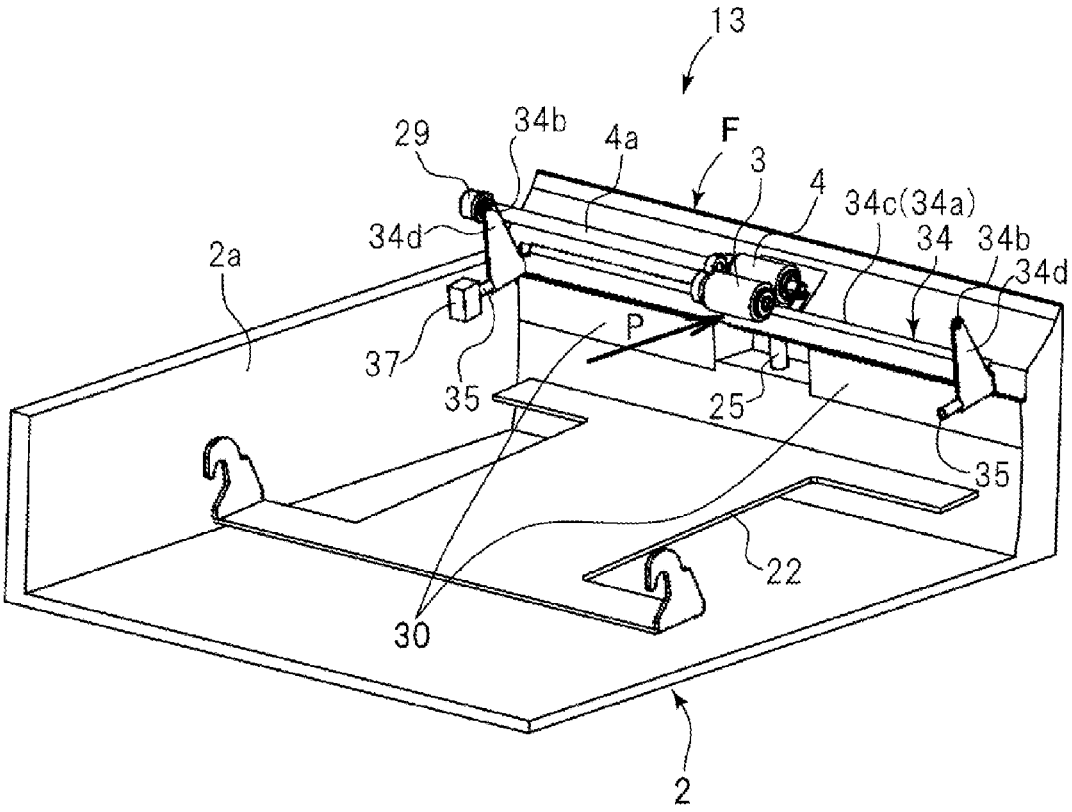
FIG. 12 is a perspective view illustrating the sheet feeding portion according to the second embodiment.

Referring to FIG. 12, the nip guide member 34 is arranged in the downstream side of a sheet feeding direction P of the sheet feeding portion 13. The nip guide member 34 has a sloped guide surface 34*a* provided in a long length member 34*c* extending in a width direction perpendicular to the sheet feeding direction P. In addition, the nip guide member 34 has a rotating member 34*d* approximately right-angled triangular rotatably supported by the rotation shaft 34*b* in the apparatus main body side while it is fixed by both end portions of the long length member 34*c*.

A spring abutment member 37 is fixed in a position facing a lower-end rear part of the rotating member 34*d* in a side wall 2*a* of a sheet cassette 2 (a near-side side wall is intentionally omitted in FIG. 12 for illustrative purposes). A compression spring 35 is compressively installed between the spring abutment member 37 and the lower-end rear part of the rotating member 34*d* (this configuration similarly applies to the near-side side wall of FIG. 12). As a result, the left and right rotating members 34*d* receive a force to rotate counterclockwise in FIG. 13 with the rotation shaft 34*b* as a supporting point and stop as it abuts on the stopper 36 while they support the long length member 34*c* (sloped guide surface 34*a*) therebetween.

It is noted that the rotation shaft 34*b* and the compression spring 35 constitute a support member. This support member is configured such that the nip guide member 34 does not recede from the feed roller 4 when a thickness t (FIG. 13A) is smaller than a predetermined distance h, and the nip guide member 34 recedes from the feed roller 4 when a thickness t (FIG. 13A) is larger than a predetermined distance h. The thickness t refers to a thickness of the sheet S bumping into the sloped guide surface 34*a* from the pickup roller 3. The predetermined distance h refers to a distance between the feed roller 4 and the guide leading-end 34*e*.

The nip guide member 34 is rotatably supported by the support member (including the rotation shaft 34*b* and the compression spring 35). The second embodiment is characterized in a position of the rotation shaft 26*b* of this support member. The shaft center SC1 (rotation center) of the rotation shaft 34*b* is provided in an area D interposed between first and second straight lines A and B. The first straight line A is a line extending opposite to the pickup roller 3 perpendicularly to the sloped guide surface 34*a* in an abutment portion where the leading end of the sheet S fed from the pickup roller 3 abuts on the sloped guide surface 34*a*. The second straight line B is a line extending to connect a feed roller shaft 4*a* of the feed roller 4 and the guide leading-end 34*e* closest to the feed roller 4. In addition, it is a condition that the area D where the feed roller shaft 4*a* of the feed roller 4 is located includes the first straight line A and does not include the second straight line B.

When a bundle of sheets S bumps into the sloped guide surface 34*a* of the nip guide member 34, the nip guide member 34 is applied a force to rotate counterclockwise with the rotation shaft 34*b* as a supporting point. However, a lower-end front part of the nip guide member 34 is restricted by the stopper 36, and further rotation is prohibited.

Figure 13A:
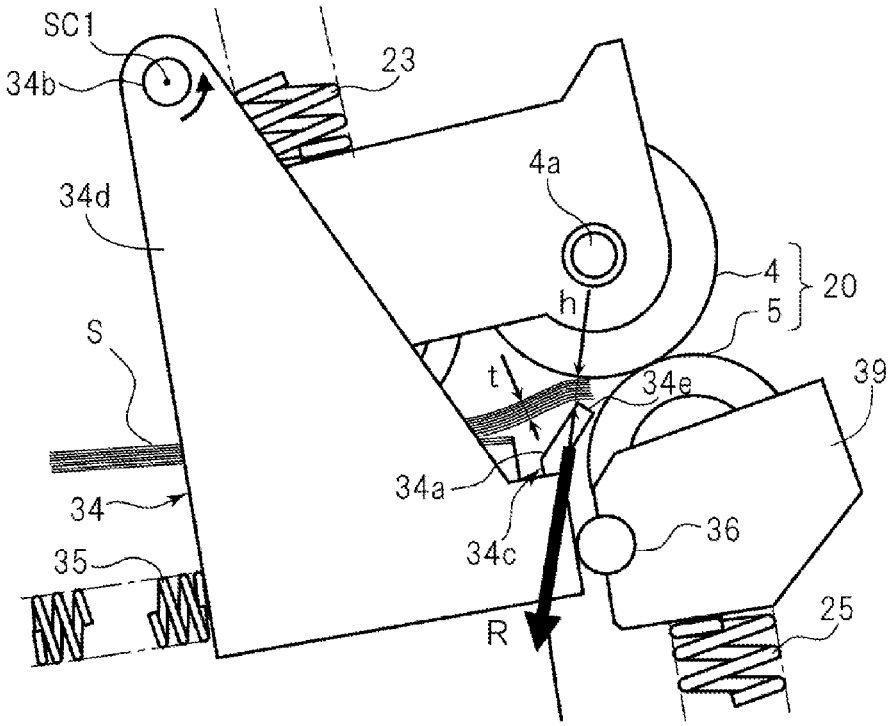
FIGS. 13A and 13B are front views illustrating the sheet feeding portion according to the second embodiment.

As illustrated in FIG. 13A, if a bundle of sheets S surpasses the sloped guide surface 34*a* as it is, and the thickness t and the closest distance h between the sloped guide surface 34*a* and the feed roller 4 have a relationship "t≥h," a nipping force of the sheet bundle is generated between an apex of the sloped guide surface 34*a* and the feed roller 4.

Figure 13B:
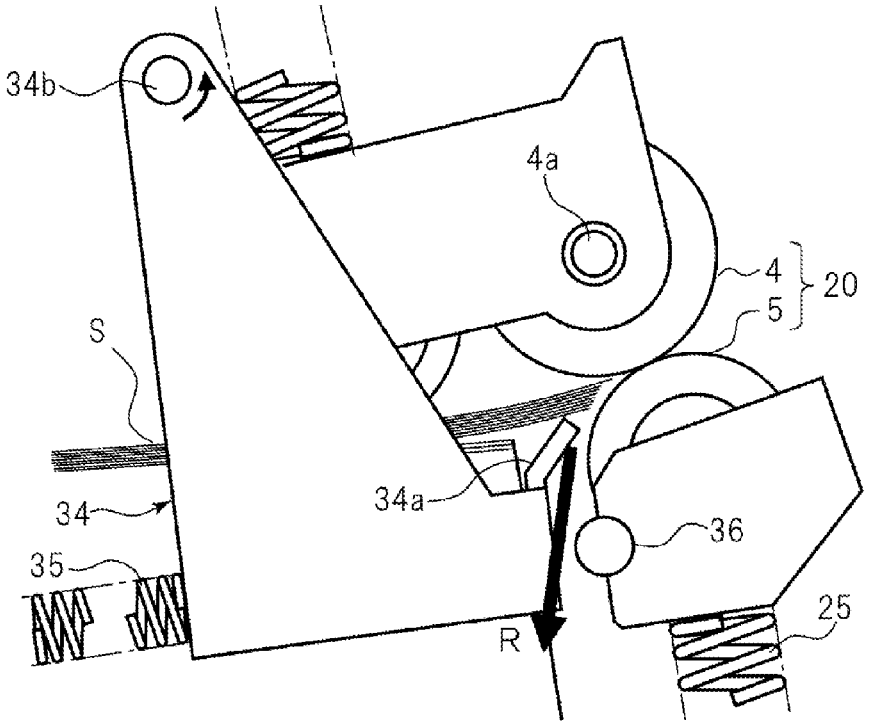

Since a reactive force of the nipping force is generated in the arrow direction R, the nip guide member 34 rotates clockwise with the rotation shaft 34*b* as a supporting point to recede (leave) from the feed roller 4 as illustrated in FIG. 13*b*. As the nip guide member 34 leaves from the feed roller 4, the nipping force applied to a bundle of sheets S in the nip guide member 34 and the feed roller 4 is generated only by the spring pressure of the compression spring 35. As a result, the nipping force applied to a bundle of sheets S is reduced.

Since a frictional force between sheets of the sheet bundle also decreases, the retard roller 5 does not rotate by a load of a torque limiter and can loosen a sheet bundle even when a bundle of sheets S reaches the separation nip portion N as it is. As a result, only a single uppermost sheet of the sheet bundle is conveyed to the downstream side.

In the sheet feeding portion 13 of second embodiment in which the rotation shaft 34*b* of the nip guide member 34 is provided in the area D of FIG. 11 as described above, it is possible to obtain the effects similar to those of the first embodiment. Specifically, it is possible to separate and feed each sheet of a sheet bundle S loaded on the sheet cassette 2 at a predetermined timing (without a delay) without damage to the downstream side.

Third Embodiment

Figure 14:
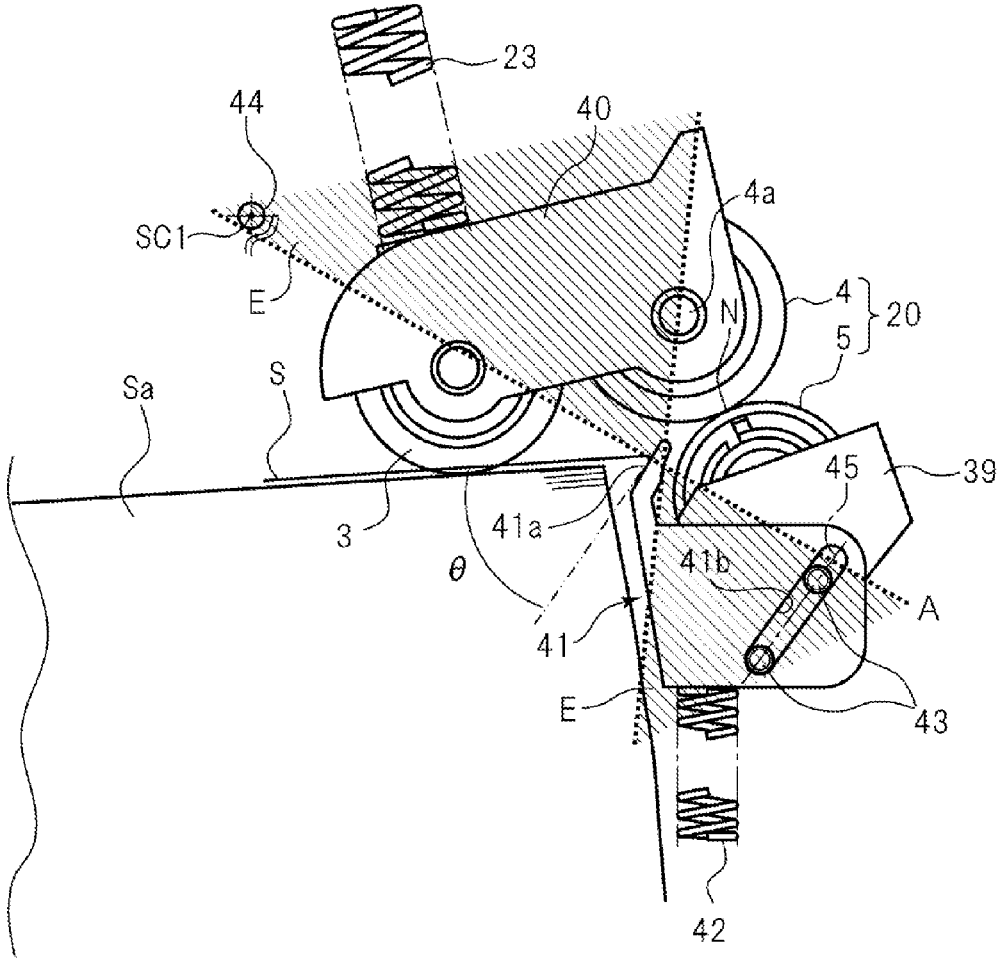
FIG. 14 is a front view illustrating a sheet feeding portion according to a third embodiment of the invention.
Figure 15:
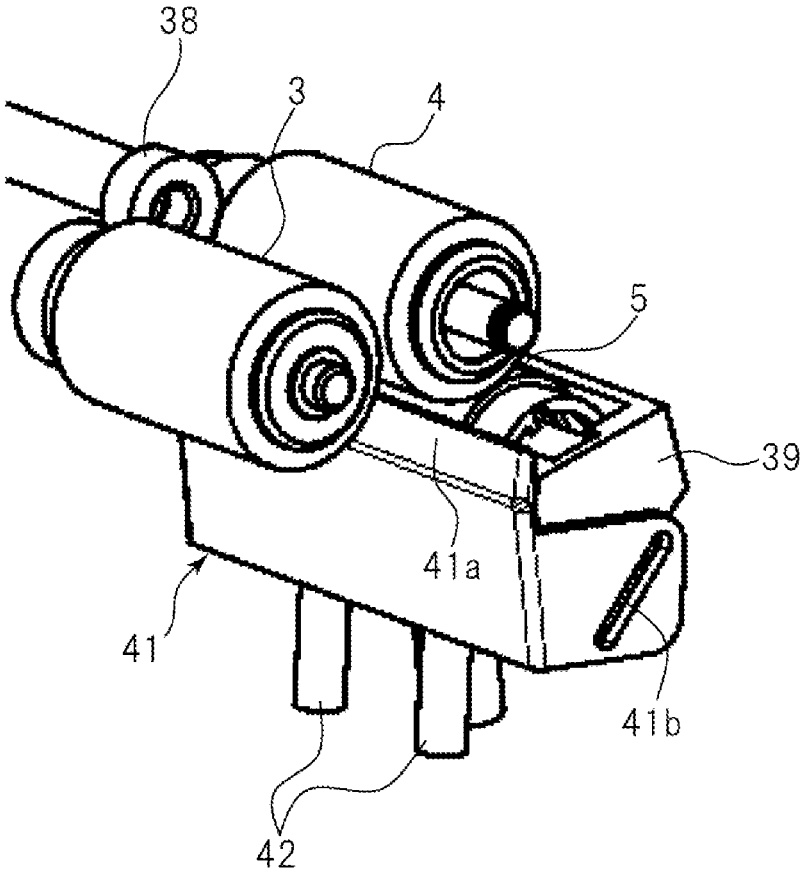
FIG. 15 is a perspective view illustrating the sheet feeding portion according to the third embodiment.

Next, a third embodiment of the invention will be described with reference to FIGS. 14 to 16. Similar to the first embodiment, a sheet feeding portion 13 as a sheet feeding apparatus mounted on an image forming apparatus 1 will be exemplarily described in the third embodiment. In the third embodiment, like reference numerals denote like elements as in the first embodiment, and descriptions thereof will not be repeated. FIGS. 14 and 16 are front views illustrating a sheet feeding portion of the third embodiment, and FIG. 15 is a perspective view illustrating the sheet feeding portion of third embodiment.

A nip guide member 41 includes a sloped guide surface 41*a* approximately planar and a slide slit 41*b*. The nip guide member 41 is supported so as to vertically slide with an inclination along a pair of guide pins 43 provided in the cassette frame F of the sheet cassette 2. It is noted that the lower guide pin 43 in the drawings serves as a restricting member.

The nip guide member 41 receives a force from a compression spring 42 serving as a biasing member to approach the feed roller 4 and is positioned as the lower guide pin 43 abuts on the slide slit 41*b*. The nip guide member 41 is positioned such that the sloped guide surface 41*a* has a predetermined angle θ with a sheet S fed by the pickup roller 3. It is noted that the slide slit 41*b*, the compression spring 42, and the guide pin 43 constitute a support member.

According to the third embodiment, the nip guide member 41 is slidably supported by the support member (including the slide slit 41*b*, the compression spring 42, and the guide pin 43). The third embodiment is characterized in the position of the support member. The slide direction (direction of the slide slit 41*b*) matches an approximate straight line of a virtual arc whose rotation center 44 exists at infinity in an area E interposed between the first and second straight lines A and B in an abutment position where a leading end of the fed sheet abuts on the sloped guide surface 41*a*.

In the third embodiment, the first straight line A is a straight line extending perpendicularly to the sloped guide surface 41*a*, and the second straight line B is a straight line extending to connect the feed roller shaft 4*a* of the feed roller 4 and the guide leading-end 41*e*. In addition, it is a condition that the area E where rotation center 44 existing at infinity is located includes the first straight line A and does not include the second straight line B.

When a bundle of sheets S bumps into the sloped guide surface 41*a* of the nip guide member 41, the nip guide member 41 is applied a force to move to the upper right side along the slide slit 41*b*. However, the movement is restricted because the nip guide member 41 already abuts the lower guide pin 43.

Figure 16A:
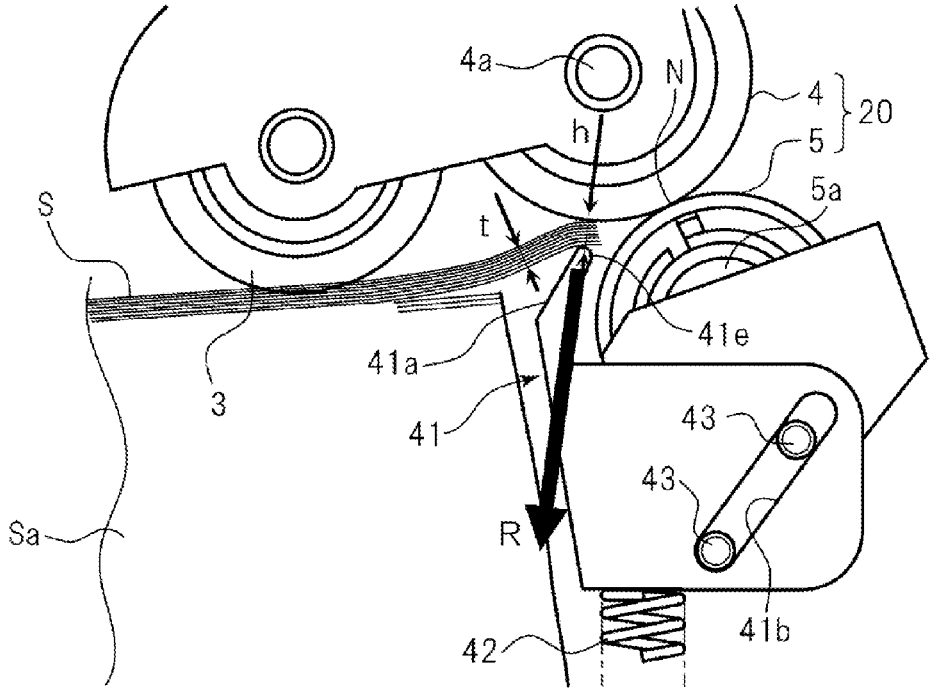
FIGS. 16A and 16B are front views illustrating the sheet feeding portion according to the third embodiment.

As illustrated in FIG. 16A, if a bundle of sheets S surpasses the sloped guide surface 41*a* of the nip guide member 41, and a thickness t of the bundle of sheets S and the closest distance h between the sloped guide surface 41*a* and the feed roller 4 has a relationship "t≥h," a nipping force of a bundle of sheets S is generated between the apex of the sloped guide surface 41*a* and the feed roller 4.

Figure 16B:
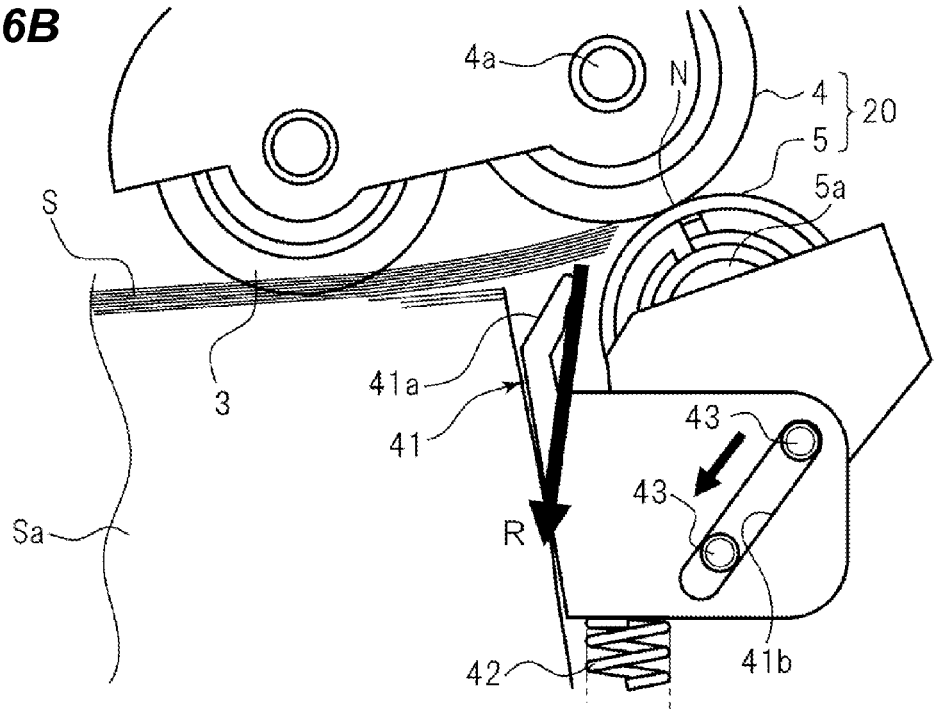

Then, a reactive force thereof is directed in the arrow direction R, and the nip guide member 41 vertically moves along the slide slit 41*b* to recede from the feed roller 4 as illustrated in FIG. 16*b*. As the nip guide member 41 recedes from the feed roller 4, a nipping force to a bundle of sheets S in the nip guide member 41 and the feed roller 4 is generated only by the spring pressure of the compression spring 42 (refer to FIG. 15). As a result, a nipping force to a bundle of sheets S is reduced.

In addition a frictional force between sheets of a sheet bundle is also reduced. Therefore, the retard roller 5 does not rotate by a load of the torque limiter even when a bundle of sheets S reaches the separation nip portion N as it is. As a result, the sheet bundle is loosened. In addition, only the uppermost sheet of the sheet bundle is fed to the downstream side.

Similar to the first and second embodiments, in the third embodiment in which the slide slit 41*b* is provided in the nip guide member 41 as described above, it is possible to reliably separate and feed each sheet of a sheet bundle Sa in the sheet cassette 2 to the downstream side without damage at a predetermined timing.

Fourth Embodiment

Next, a fourth embodiment of the invention will be described with reference to FIG. 17. Similar to the first embodiment, in the fourth embodiment, a sheet feeding portion 13 as a sheet feeding apparatus mounted on an image forming apparatus 1 will be exemplarily described. In the fourth embodiment, like reference numerals denote like elements as in the third embodiment, and descriptions thereof will not be repeated. Similar to the third embodiment, FIG. 17 is a front view illustrating a sheet feeding portion different from a sway type.

Figure 17:
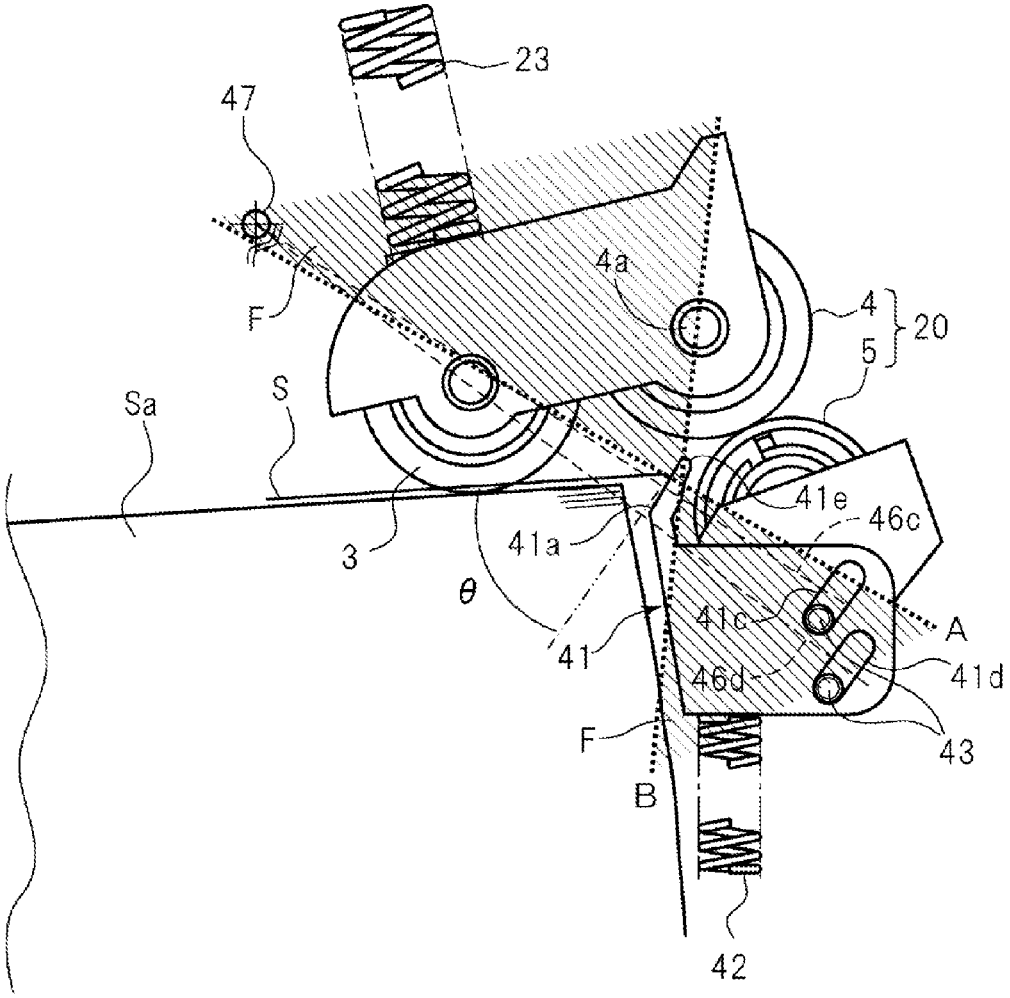
FIG. 17 is a front view illustrating a sheet feeding portion according to a fourth embodiment of the invention.
Figure 18:
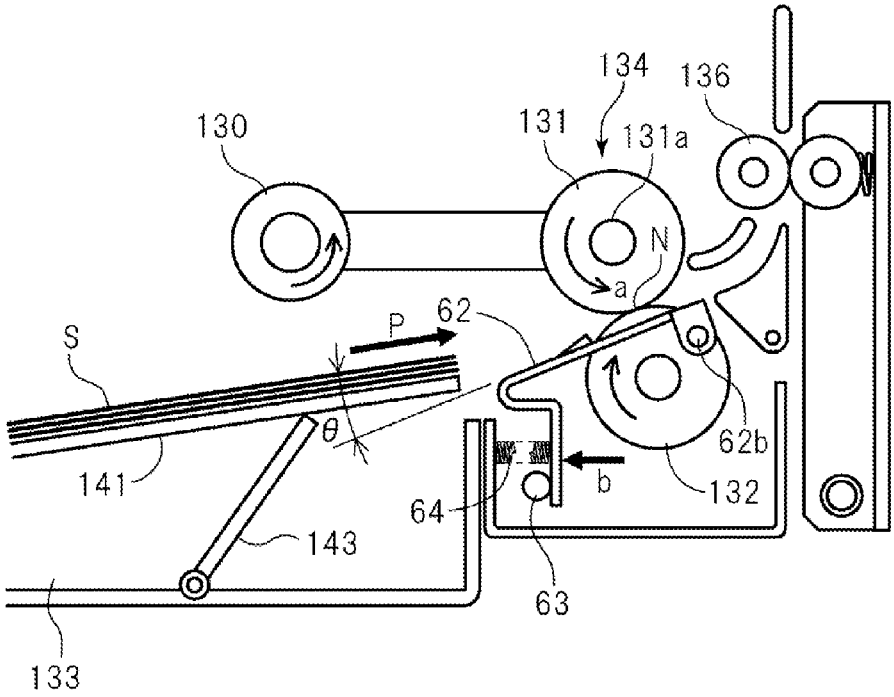
FIG. 18 PRIOR ART
FIG. 18 is a cross-sectional view illustrating a feed member of the related art.
Figure 19A:
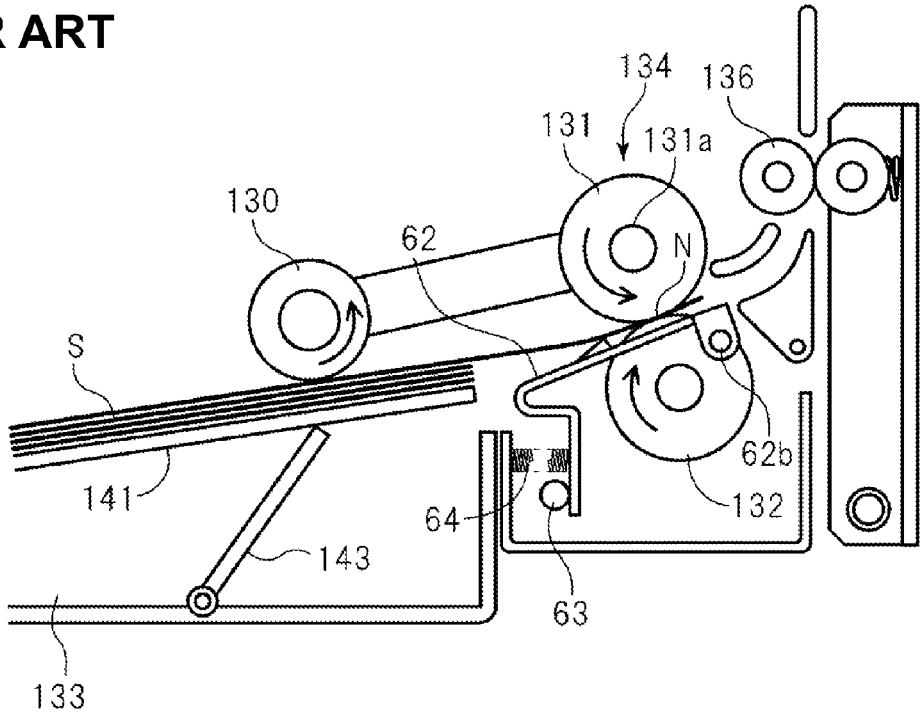
FIG. 19A PRIOR ART
FIGS. 19A and 19B are cross-sectional views illustrating a feed member of the related art.
Figure 19B:
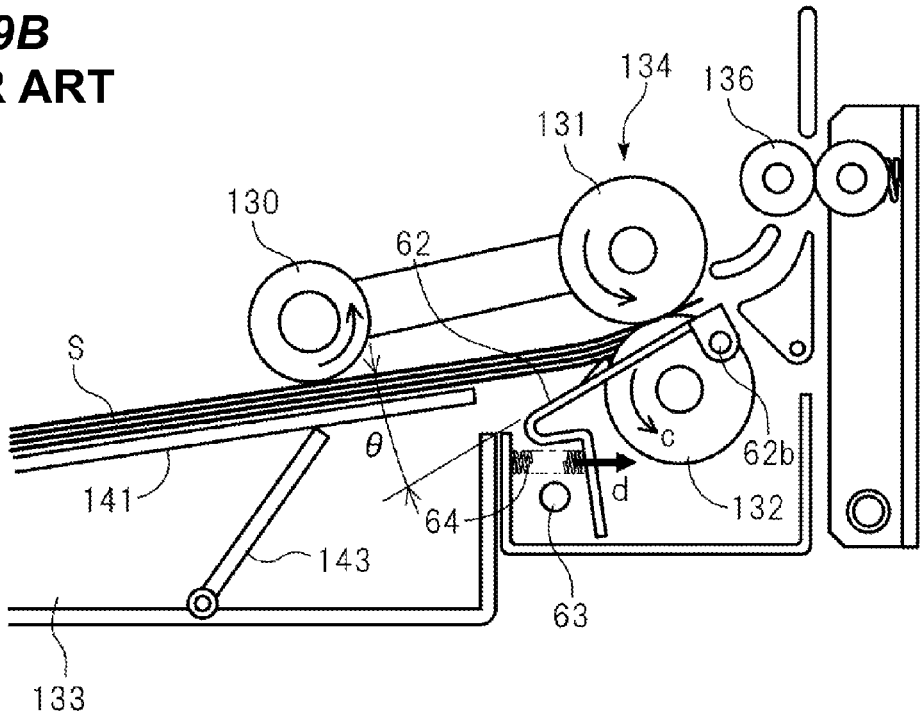
FIG. 19B PRIOR ART

Referring to FIG. 17, a nip guide member 41 according to the fourth embodiment includes a pair of slide slits 41*c* and 41*d* parallel to each other. Guide pins 43 are provided on the cassette frame F of the sheet cassette 2. In the nip guide member 41, guide pins 43 sliding and inserted into the corresponding slide slits 41*c* and 41*d* vertically slide to move with an inclination. In this movement locus, a virtual rotation center 47 serves as a supporting point (rotation center). It is noted that the slide slit 41*c* and 41*d*, the compression spring 42, and the guide pin 43 constitute a support member. In addition, the guide pin 43 constitutes a restricting member.

The virtual rotation center 47 is an intersection between a straight line 46*c* that passes through a center of the slide slit 41*c* and is perpendicular to a slide direction and a straight line 46*d* that passes through a center of the slide slit 41*d* and is perpendicular to the slide direction. Since the virtual rotation center 47 is located in an area F similar to the hatching area E described in FIG. 8, it is possible to obtain the effect similar to that of the slide type of FIG. 14.

Similar to the third embodiment, in the fourth embodiment, the nip guide member 41 is slidably supported by the support member (including the slide slits 41*c* and 41*d*, the compression spring 42, and the guide pins 43). The fourth embodiment is characterized in the location of the support member. The slide direction (direction of the slide slits 41*c* and 41*d*) matches a direction of the approximate straight line of a virtual arc whose rotation center 47 exists at infinity in the area F interposed between the first and second straight lines A and B in an abutment position where a leading end of the fed sheet abuts on the sloped guide surface 41*a*.

Similar to the third embodiment, in the fourth embodiment, the first straight line A is a straight line extending perpendicularly to the sloped guide surface 41*a*, and the second straight line B is a straight line extending to connect the feed roller shaft 4*a* of the feed roller 4 and the guide leading-end 41*e*. In addition, it is a condition that the area F where the rotation center 47 existing at infinity is located includes the first straight line A and does not include the second straight line B.

Similar to the third embodiment, in the fourth embodiment in which the slide slits 41*c* and 41*d* are provided in the nip guide member 41, it is possible to reliably separate and feed each sheet of a sheet bundle Sa loaded on the sheet cassette 2 without damage at a predetermined timing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A sheet feeding apparatus comprising:

a conveying roller;

a separation member which presses against the conveying roller to form a separation nip portion that separates received sheets one by one;

a feeding member configured to feed a sheet towards the separation nip portion;

a nip guide member including a first guide portion configured to contact with a leading edge of the sheet fed by the feeding member and a second guide portion disposed at facing position facing the conveying roller and configured to guide the sheet to the separation nip portion;

a biasing member configured to bias the nip guide member; and a restricting portion configured to regulate a position of the nip guide member, wherein in a case that thickness of a sheet bundle fed by the feeding member is larger than a distance between the second guide portion and the conveying roller so that the second guide portion is pressed by the sheet bundle, the second guide portion of the nip guide member is pushed by the sheet bundle to make the nip guide member move apart from the restricting portion in opposition to biasing force of the biasing member, and wherein in a case that the first guide portion is pressed by the sheet fed by the feeding member, the nip guide member is positioned on the restriction portion by using a pressing force caused by the first guide portion to be pressed by the sheet and a biasing force of the biasing member.

2. The sheet feeding apparatus according to claim 1, further comprising a support member configured to movably support the nip guide member.

3. The sheet feeding apparatus according to claim 1, further comprising a sheet storing portion which is capable of loading a plurality of fed sheets and which includes a restricting wall surface that restricts a leading end of a loaded sheet in a feeding direction, wherein the restricting wall surface is arranged closer to a sheet in the sheet storing portion relative to the nip guide member.

4. The sheet feeding apparatus according to claim 1, wherein the restricting portion is further configured to regulate a movement of the nip guide member.

5. The sheet feeding apparatus according to claim 1, wherein the nip guide member is contacted with the restricting portion to be positioned in a case that the first guide portion is pressed by the sheet fed from the feeding member.

6. The sheet feeding apparatus according to claim 1, wherein the first guide portion is disposed at an upstream side from the second guide portion in a sheet conveying direction.

7. The sheet feeding apparatus according to claim 1, wherein the first guide portion and the second guide portion are different surfaces of the nip guide member.

8. The sheet feeding apparatus according to claim 7, wherein the first guide portion is a surface facing the feeding member and not facing the conveying roller.

* * * * *